US011172703B2

(12) United States Patent
Williams et al.

(10) Patent No.: US 11,172,703 B2
(45) Date of Patent: Nov. 16, 2021

(54) TONGUE AND TONGUE ASSEMBLY FOR ROD FORMING APPARATUS, ROD FORMING APPARATUS WITH TONGUE ASSEMBLY AND METHOD OF INSTALLING TONGUE ASSEMBLY ON ROD FORMING APPARATUS

(71) Applicant: Altria Client Services LLC, Richmond, VA (US)

(72) Inventors: Dwight D. Williams, Powhatan, VA (US); Charles David Howe, Crewe, VA (US)

(73) Assignee: Altria Client Services LLC, Richmond, VA (US)

( * ) Notice: Subject to any disclaimer, the term of this patent is extended or adjusted under 35 U.S.C. 154(b) by 0 days.

(21) Appl. No.: 16/663,886

(22) Filed: Oct. 25, 2019

(65) Prior Publication Data

US 2021/0120863 A1 Apr. 29, 2021

(51) Int. Cl.
*A24C 5/18* (2006.01)
*A24C 1/02* (2006.01)

(52) U.S. Cl.
CPC ..... *A24C 5/1807* (2013.01); *A24C 1/02* (2013.01); *A24C 5/1842* (2013.01); *A24C 5/1892* (2013.01)

(58) Field of Classification Search
CPC ..... A24C 5/18; A24C 5/1807; A24C 5/1842; A24C 5/1892
See application file for complete search history.

(56) References Cited

U.S. PATENT DOCUMENTS

| | | | | |
|---|---|---|---|---|
| 1,630,488 | A | 5/1927 | Di Ianni | |
| 4,010,762 | A | 3/1977 | Strydom | |
| 4,619,276 | A | 10/1986 | Albertson et al. | |
| 4,917,118 | A | 4/1990 | Mangiarotti | |
| 4,979,521 | A * | 12/1990 | Davis | A24C 5/1892 131/286 |
| 5,413,121 | A | 5/1995 | Dawson et al. | |
| 5,810,016 | A | 9/1998 | Okumoto | |
| 7,827,994 | B2 | 11/2010 | Spiers et al. | |
| 9,295,284 | B2 | 3/2016 | Prestia et al. | |
| 2007/0193591 | A1 | 8/2007 | Andersen et al. | |
| 2014/0048083 | A1 | 2/2014 | Williams et al. | |
| 2017/0013872 | A1 | 1/2017 | Williams et al. | |

FOREIGN PATENT DOCUMENTS

GB 579029 A 7/1946

OTHER PUBLICATIONS

Notice of Allowance dated Jun. 8, 2021, issued in corresponding U.S. Appl. No. 16/663,787.

* cited by examiner

*Primary Examiner* — Eric Yaary
(74) *Attorney, Agent, or Firm* — Harness, Dickey & Pierce, P.L.C.

(57) ABSTRACT

The tongue includes a shaft, the shaft being hollow. The tongue includes an upper plate connected to the shaft. The upper plate includes a first protrusion on a first side of the upper plate, and a second protrusion on the first side of the upper plate. The first protrusion and the second protrusion define a notch. The first protrusion runs along at least part of an upper portion of a longitudinal length of the shaft. The rod forming apparatus includes the tongue. The method installs the tongue on the rod forming apparatus.

34 Claims, 27 Drawing Sheets

(VIEW F-F)

(VIEW G-G)

(VIEW A-A)

(VIEW B-B)

TONGUE AND TONGUE ASSEMBLY FOR ROD FORMING APPARATUS, ROD FORMING APPARATUS WITH TONGUE ASSEMBLY AND METHOD OF INSTALLING TONGUE ASSEMBLY ON ROD FORMING APPARATUS

BACKGROUND

Field

Example embodiments generally relate to a tongue, and a tongue assembly, for a rod forming apparatus, a rod forming apparatus with the tongue assembly, and a method of installing the tongue assembly on the rod forming apparatus.

Description of Related Art

During the manufacture of cigars, tobacco can have a relatively high cost. Therefore, an efficient use of tobacco is important. High-quality cigars should be uniformly and consistently filled.

SUMMARY

At least one example embodiment is directed toward a tongue for rod forming.

In one example embodiment, the tongue includes a shaft, the shaft being hollow; and an upper plate connected to the shaft, the upper plate including, a first protrusion on a first side of the upper plate, and a second protrusion on the first side of the upper plate, the first protrusion and the second protrusion defining a notch, and the first protrusion running along at least part of an upper portion of a longitudinal length of the shaft.

In one example embodiment, the shaft includes, an inner surface that faces away from the upper plate, the inner surface having a first end and a second end, a first inlet on the first end of the inner surface, an outlet on the second end of the inner surface, wherein the inner surface, the first inlet and the outlet are arcuate-shaped.

In one example embodiment, the first inlet has a first radius of curvature that is larger than a second radius of curvature of the outlet.

In one example embodiment, the inner surface has a continually reducing radius of curvature from the first end to the second end of the inner surface.

In one example embodiment, the shaft further includes, a second inlet connected to the first end of the inner surface, the second inlet defining an opening with a first cross-sectional flow area that is one of rectangular-shaped or square-shaped, and a tapered entrance between the second inlet and the first inlet.

In one example embodiment, the first cross-sectional flow area is larger than a second cross-sectional flow area of the first inlet, and the second cross-sectional flow area is larger than a third cross-sectional flow area of the outlet.

In one example embodiment, the shaft defines an injection port, the injection port being configured to inject at least one substance onto the inner surface, the at least one substance being at least one of water, at least one flavorant, at least one additive, or combinations thereof.

In one example embodiment, the upper plate defines one or more mounting bolt holes.

In one example embodiment, the upper plate defines at least two mounting bolt holes, and at least one of the at least two mounting bolts holes is defined by the second protrusion.

In one example embodiment, the notch is substantially V-shaped with a flattened vertex.

At least one example embodiment is directed toward a tongue assembly with the tongue, and a lower mounting plate connected to a lower portion of the tongue.

In one example embodiment, a lower end of the lower mounting plate includes a third protrusion, the third protrusion being positioned to at least partially align and mount the tongue assembly onto a lower plate of a rod forming apparatus.

In one example embodiment, the shaft is configured to longitudinally align with a groove defined by the lower plate in order to at least partially define a channel.

In one example embodiment, the shaft defines an injection port, the injection port being configured to inject at least one substance into the channel, the at least one substance being at least one of water, at least one flavorant, at least one additive, or combinations thereof.

In one example embodiment, the shaft has a continually reduced cross-sectional flow area from an inlet to an outlet of the shaft.

In one example embodiment, the upper plate and the lower mounting plate each define at least one pair of mounting bolt holes, each of the at least one pair of mounting bolt holes being configured to further align and mount the tongue assembly onto the lower plate.

In one example embodiment, the lower mounting plate includes a shelf, the shelf extending from an inner side of the lower mounting plate toward the shaft once the tongue assembly is assembled, the shelf including an upwardly facing inclined surface that inclines away from the shaft.

In one example embodiment, the upwardly facing inclined surface is configured to at least partially assist in folding a lap edge of a covering of a rolled consumer product toward an upper surface of the shaft, as the lap edge of the covering travels through an opening defined by the tongue assembly, if the tongue assembly is mounted onto a rod forming apparatus.

In one example embodiment, the opening is at least partially defined by, an inner side surface of the shaft, the upwardly facing inclined surface, and a lower surface of the upper plate.

In one example embodiment, the upwardly facing inclined surface is tapered, such that a width of the upwardly facing inclined surface is continually reduced from a front end to a back end of the upwardly facing inclined surface.

In one example embodiment, the upper plate includes an upper surface and a lower surface, the lower surface mating with a first surface of the lower mounting plate, the lower surface and the first surface each being substantially flat.

In one example embodiment, the tongue assembly further includes an upper mounting plate connected to a top portion of the tongue.

In one example embodiment, the upper plate includes an upper surface and a lower surface, the upper surface mating with a first surface of the upper mounting plate and the lower surface mating with a second surface of the lower mounting plate, the upper surface, the lower surface, the first surface, and the second surface each being substantially flat.

In one example embodiment, the upper mounting plate includes a fourth protrusion and a fifth protrusion, the fourth protrusion mating with the first protrusion and the fifth protrusion mating with the second protrusion.

In one example embodiment, the fourth protrusion defines at least two bolt holes, the at least two bolt holes being on either side of the first protrusion, the at least two bolt holes being configured to align the upper plate with the upper mounting plate.

In one example embodiment, the upper plate defines a first notch, and the upper mounting plate defines a second notch, the first notch and the second notch being substantially aligned with each other.

In one example embodiment, the first notch and the second notch are both substantially V-shaped.

At least one example embodiment is directed toward a rod forming apparatus.

In one example embodiment, the rod forming apparatus includes an in-feed section configured to convey a column of tobacco in a downward direction; a finishing section configured to receive the column of tobacco, the finishing section being configured to roll the column of tobacco into a wrapped tobacco rod, the finishing section including a tongue, the tongue including, a shaft, the shaft being hollow, an upper plate connected to the shaft, the upper plate including, a first protrusion on a first side of the upper plate, and a second protrusion on the first side of the upper plate, the first protrusion and the second protrusion defining a notch, and the first protrusion running along at least part of an upper portion of a longitudinal length of the shaft.

In one example embodiment, the in-feed section includes, an upper belt and an in-feed belt, the upper belt and the in-feed belt defining a descending channel, the descending channel being configured to convey the column of tobacco in the downward direction, a pair of squeeze bars that are configured to receive the column of tobacco from the descending channel, the pair of squeeze bars being configured to compress the column of tobacco, a lower belt configured to move the column of tobacco through the pair of squeeze bars and into the finishing section, and the lower belt being further configured to move at least one covering, positioned below the column of tobacco, into the finishing section.

In one example embodiment, the finishing section further includes, a compression box, the compression box including a lower plate defining a groove, wherein the shaft of the tongue is configured to longitudinally align with the groove, the compression box being configured to further compression the column of tobacco into a tobacco rod, an adhesive applicator, the adhesive applicator being configured to apply an adhesive to a portion of the at least one covering, one or more folders downstream of the compression box, the one or more folders being configured to fold the at least one covering, with the adhesive, around the tobacco rod, and a cutter, the being configured to cut the tobacco rod into rolled consumer products.

At least one example embodiment is directed toward a method of installing a tongue assembly on a rod forming apparatus.

In one example embodiment, the method includes aligning a shaft of a tongue with a groove, the groove being defined by a lower plate of a compression box; bolting an upper plate onto the lower plate to stabilize the aligned shaft with the groove, the tongue including, the shaft, the shaft being hollow, an upper plate connected to the shaft, the upper plate including, a first protrusion on a first side of the upper plate, and a second protrusion on the first side of the upper plate, the first protrusion and the second protrusion defining a notch, and the first protrusion running along at least part of an upper portion of a longitudinal length of the shaft.

In one example embodiment, the bolting of the upper plate onto the lower plate includes, connecting a lower mounting plate to the upper plate by mating a first upper surface of the lower mounting plate to a first lower surface of the upper plate, the first upper surface and the first lower surface being substantially flat, the lower mounting plate and the upper plate being configured to be bolted together onto the lower plate, the lower mounting plate including, a shelf, the shelf extending from an inner side of the lower mounting plate toward the shaft once the lower mounting plate is connected to the upper plate, the shelf including an upwardly facing inclined surface that inclines away from the shaft.

In one example embodiment, the bolting of the upper plate onto the lower plate further includes, connecting an upper mounting plate to the upper plate by mating a second upper surface of the upper plate to a second lower surface of the upper mounting plate, the second upper surface and the second lower surface being substantially flat, the lower mounting plate, the upper mounting plate and the upper plate being configured to be bolted together onto the lower plate, the upper mounting plate including, a fourth protrusion and a fifth protrusion, the fourth protrusion mating with the first protrusion and the fifth protrusion mating with the second protrusion.

In one example embodiment, the upper plate defines a first notch, and the upper mounting plate defines a second notch, the first notch and the second notch being substantially aligned with each other once the upper mounting plate is connected to the upper plate.

BRIEF DESCRIPTION OF THE DRAWINGS

The various features and advantages of the non-limiting embodiments herein may become more apparent upon review of the detailed description in conjunction with the accompanying drawings. The accompanying drawings are merely provided for illustrative purposes and should not be interpreted to limit the scope of the claims. The accompanying drawings are not to be considered as drawn to scale unless explicitly noted. For purposes of clarity, various dimensions of the drawings may have been exaggerated.

DETAILED DESCRIPTION

Figure 1:
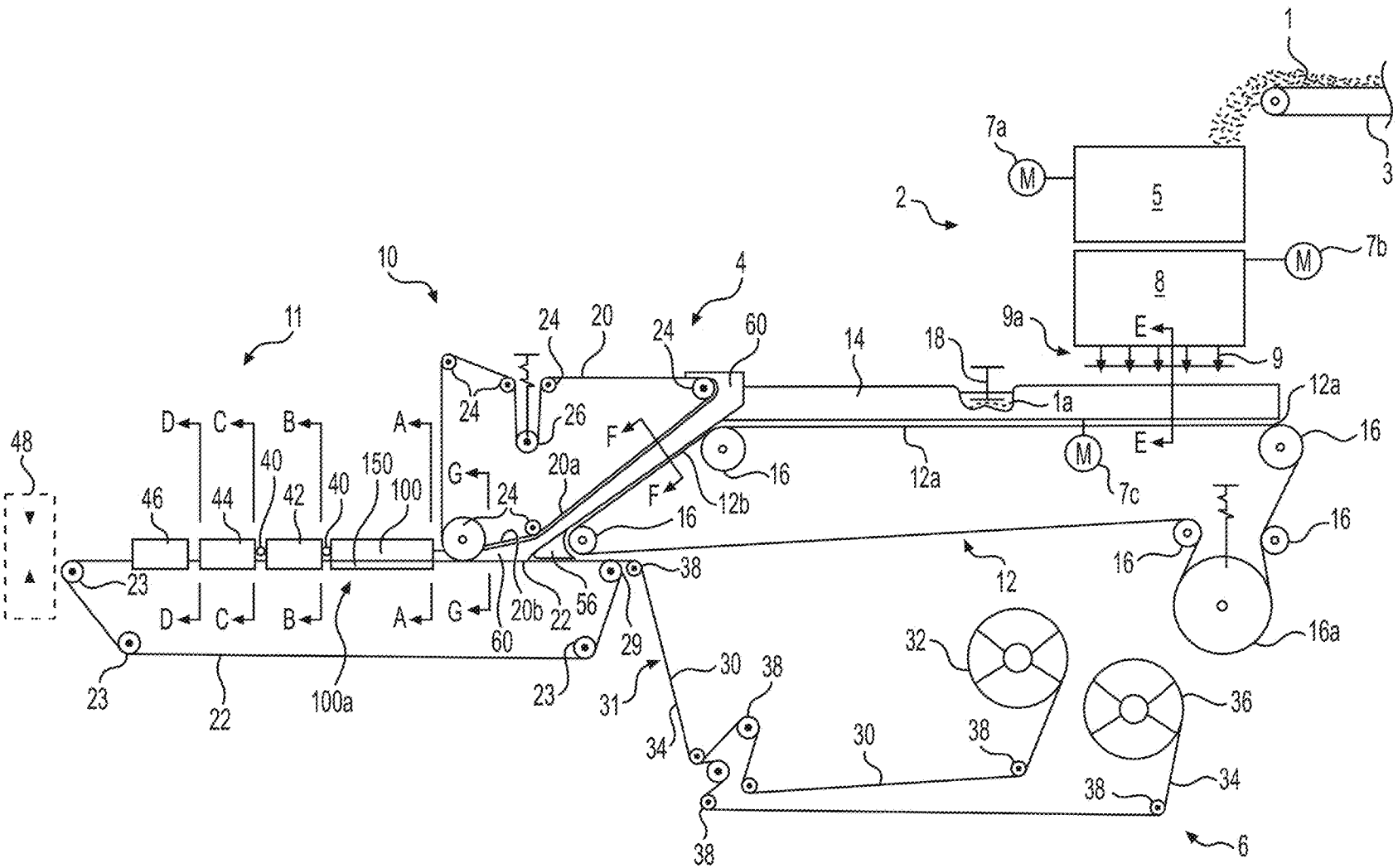
FIG. 1 is an illustration of a rod forming apparatus, in accordance with an example embodiment.

Some detailed example embodiments are disclosed herein. However, specific structural and functional details disclosed herein are merely representative for purposes of describing example embodiments. Example embodiments may, however, be embodied in many alternate forms and should not be construed as limited to only the example embodiments set forth herein.

Accordingly, while example embodiments are capable of various modifications and alternative forms, example embodiments thereof are shown by way of example in the drawings and will herein be described in detail. It should be understood, however, that there is no intent to limit example embodiments to the particular forms disclosed, but to the contrary, example embodiments are to cover all modifications, equivalents, and alternatives thereof. Like numbers refer to like elements throughout the description of the figures.

It should be understood that when an element or layer is referred to as being "on," "connected to," "coupled to," or "covering" another element or layer, it may be directly on, connected to, coupled to, or covering the other element or layer or intervening elements or layers may be present. In contrast, when an element is referred to as being "directly on," "directly connected to," or "directly coupled to" another element or layer, there are no intervening elements or layers present. Like numbers refer to like elements throughout the specification. As used herein, the term "and/or" includes any and all combinations or sub-combinations of one or more of the associated listed items.

It should be understood that, although the terms first, second, third, etc. may be used herein to describe various elements, regions, layers and/or sections, these elements, regions, layers, and/or sections should not be limited by these terms. These terms are only used to distinguish one element, region, layer, or section from another region, layer, or section. Thus, a first element, region, layer, or section discussed below could be termed a second element, region, layer, or section without departing from the teachings of example embodiments.

Spatially relative terms (e.g., "beneath," "below," "lower," "above," "upper," and the like) may be used herein for ease of description to describe one element or feature's relationship to another element(s) or feature(s) as illustrated in the figures. It should be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the term "below" may encompass both an orientation of above and below. The device may be otherwise oriented (rotated 90 degrees or at other orientations) and the spatially relative descriptors used herein interpreted accordingly.

The terminology used herein is for the purpose of describing various example embodiments only and is not intended to be limiting of example embodiments. As used herein, the singular forms "a," "an," and "the" are intended to include the plural forms as well, unless the context clearly indicates otherwise. It will be further understood that the terms "includes," "including," "comprises," and/or "comprising," when used in this specification, specify the presence of stated features, integers, steps, operations, and/or elements, but do not preclude the presence or addition of one or more other features, integers, steps, operations, elements, and/or groups thereof.

When the words "about" and "substantially" are used in this specification in connection with a numerical value, it is intended that the associated numerical value include a tolerance of ±10% around the stated numerical value, unless otherwise explicitly defined.

Unless otherwise defined, all terms (including technical and scientific terms) used herein have the same meaning as commonly understood by one of ordinary skill in the art to which example embodiments belong. It will be further understood that terms, including those defined in commonly used dictionaries, should be interpreted as having a meaning that is consistent with their meaning in the context of the relevant art and will not be interpreted in an idealized or overly formal sense unless expressly so defined herein.

Example embodiments are described herein with reference to cross-sectional illustrations that are schematic illustrations of idealized embodiments (and intermediate structures) of example embodiments. As such, variations from the shapes of the illustrations as a result, for example, of manufacturing techniques and/or tolerances, are to be expected. Thus, example embodiments should not be construed as limited to the shapes of regions illustrated herein but are to include deviations in shapes that result, for example, from manufacturing.

FIG. 1 is an illustration of a rod forming apparatus 10, in accordance with an example embodiment. In an example embodiment, the rod forming apparatus 10 is used for the formation of a consumer product 300 (see FIG. 16). In an example embodiment, the consumer product 300 is a rolled product. In an example embodiment, the consumer product 300 is a rolled tobacco product, such as a tobacco rod. In an example embodiment, the tobacco rod is a cigar, a cigarette, or both a cigar and a cigarette.

In an example embodiment, the rod forming apparatus 10 includes a feed section 2, an in-feed section 4, a web section 6 and a finishing section 11. In an example embodiment, the feed section 2 includes at least one conveyer 3 for receiving tobacco 1 from a tobacco source (not shown). In an example embodiment, the tobacco 1 is shredded tobacco, as described in more detail herein. In an example embodiment, the feed section 2 includes a storage container 5 that may be at least one of a reservoir, a vat, a shipping container, etc. In an example embodiment, the rod forming apparatus 10 does not include a conveyor 3, as the tobacco 1 may be manually placed into the storage container 5, or the storage container 5 may be used until depleted and then replaced with another storage container 5.

In an example embodiment, the feed section 2 includes a feeder 8. The feeder 8 may be physically located below the storage container 5, and may receive tobacco 1 from the storage container 5. In an example embodiment, the feed section 2 does not include a storage container 5, and instead includes the feeder 8 and/or the conveyor 3. In an example embodiment, the storage container 5 and the feeder 8 are one integral element. Other configurations of the feed section 2 are contemplated.

In an example embodiment, the feeder 8 includes one or more outlets 9 at a lower portion of the feeder 8. In an example embodiment, the one or more outlets 9 are distributed in an outlet array 9*a*. In an example embodiment, the feeder 8 is a vibratory waterfall type feeder. In an example embodiment, the storage container 5, or the feeder 8, or both the storage container 5 and the feeder 8 include at least one electromagnetic (motorized) vibrator 7*a*/7*b* for causing the tobacco 1 to vibrate and uniformly settle, as the tobacco 1 leaves the storage container 5 and/or the feeder 8.

Figure 2:
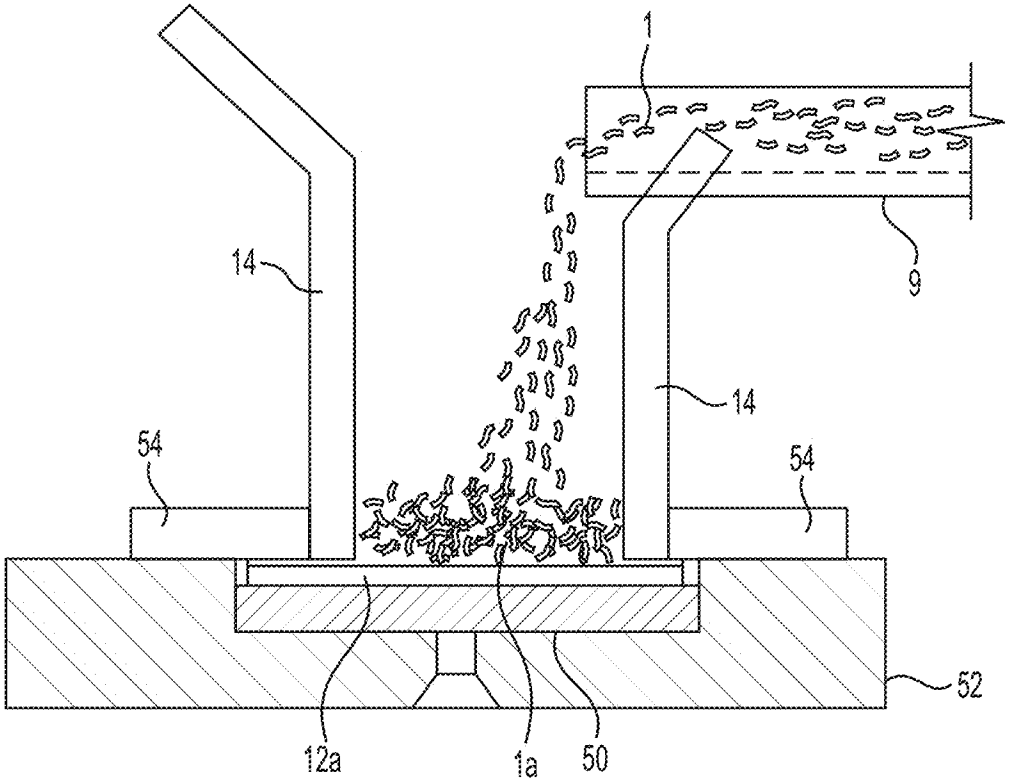
FIG. 2 is an illustration of a cross-sectional view of a portion of a feed section of FIG. 1, in accordance with an example embodiment.

In an example embodiment, the feeder 8 and/or the outlets 9 are capable of distributing the tobacco 1 onto an upper (conveyor) belt 12, as shown in better detail in FIG. 2. In an example embodiment, a first belt section 12*a* of the upper belt 12 is at least partially enclosed by a trough 14. The upper belt 12 may include rollers 16 capable of causing the upper belt 12 to move and transport the tobacco 1. In an example embodiment, the upper belt 12 includes a tensioning (biased) roller 16*a* that adjusts a tension of the upper belt 12. In an example embodiment, a trimmer unit 18 is included along the first belt section 12*a* so that a tobacco column 1*a* traveling along the first belt section 12*a* may be formed into a column with a desired and uniform height. In an example embodiment, the first belt section 12*a* includes at least one electromagnetic vibrator 7*c* to further ensure an evenly distributed tobacco column 1*a* that is spread across the first belt section 12*a*, as the tobacco column 1*a* rides along the first belt section 12*a*.

In an example embodiment, the feed section 2 and upper belt 12 provide the tobacco column 1*a* to the in-feed section 4 of the roll forming apparatus 10. In an example embodiment, the tobacco column 1*a* is transferred into the in-feed section 4 by a second belt section 12*b* of the upper belt 12 and an in-feed (compression) belt 20 that are downstream of the feeder 8. Specifically, in an example embodiment, the tobacco column 1*a* rides on the second belt section 12*b* (shown in better detail FIG. 3), while a descending belt section 20*a* of the in-feed belt 20 is in contact with a top portion of the tobacco column 1*a*. In an example embodiment, the in-feed belt 20 can be considered a compression belt, from the standpoint that the in-feed belt 20 helps assist in gently compressing the tobacco column 1*a*, as explained herein in more detail (see FIG. 3 in particular). In an example embodiment, the in-feed belt 20 travels along rollers 24. In an example embodiment, a tensioning roller 26 is included in the in-feed section 4 to adjust a tension of the in-feed belt 20.

In an example embodiment, the second belt section 12*b* and/or the descending belt section 20*a* feed the tobacco column 1*a* into the finishing section 11 of the rod forming apparatus 10. In an example embodiment, the second belt section 12*b* and/or the descending belt section 20*a* feed the tobacco column 1*a* to a lower belt 22. In an example embodiment, the lower belt 22 is a garniture belt, or a garniture tube belt. In an example embodiment, the lower belt 22 travels along a set of rollers 23.

In an example embodiment, the tobacco column 1*a* enters the finishing section 11 through a channel 21. In an example embodiment, the channel has a continually and linearly decreasing cross-sectional area, as described in detail in association with FIGS. 3-7. In an example embodiment, the channel 21 is at least partially defined by a first squeeze bar 60 and a second squeeze bar 62 (see FIGS. 1, and 5-7), the descending belt section 20*a* of the in-feed belt 20 (see FIGS. 1 and 3-6), the second belt section 12*b* (see FIGS. 1 and 3-6) and the lower belt 22 (see FIGS. 1, 3 and 7). In an example embodiment, the first squeeze bar 60 and the second squeeze bar 62 hold the tobacco column 1*a* between the descending belt section 20*a* and the second belt section 12*b*, as the tobacco column 1*a* descends down to the lower belt 22, and the first squeeze bar 60 and the second squeeze bar 62 hold the tobacco column 1*a* between a horizontal belt section 20*b* of the in-feed belt 20 and the lower belt 22, as the tobacco column 1*a* is transported to a compression box 100*a* of the finishing section 11. In an example embodiment, the continually decreasing cross-sectional area of the channel 21 forces the tobacco column 1*a* to become compressed into an ever-smaller cross-section, until the tobacco column 1*a* reaches a desired cross-sectional dimension that enters the compression box 100*a*.

In an example embodiment, the rod forming apparatus 10 includes the web section 6, where the web section 6 provides at least one covering 31 that may be applied longitudinally around the consumer product 300. In an example embodiment, the at least one covering 31 includes at least two web layers. In an example embodiment, the at least one covering 31 includes a binder web 30 and a wrapper web 34. In an example embodiment, the binder web 30 is used to bind the tobacco 1, and in doing so, the binder web 30 may come into intimate direct contact with the tobacco 1. In an example embodiment, the wrapper web 34 is used to cover the binder web 30. In an example embodiment, a bulk portion of the binder web 30 and the wrapper web 34 are respectively housed on a binder reel 32 and a wrapper reel 36. A series of rollers 38 may be used to guide the binder web 30 and the wrapper web 34 into the finishing section 11. In an example embodiment, the binder web 30 and the wrapper web 34 are formed from tobacco, tobacco pulp, compressed tobacco, or a derivative or extract of tobacco, where the binder web 30 and the wrapper web 34 are in the form of flatten sheets or ribbons.

Figure 15A:
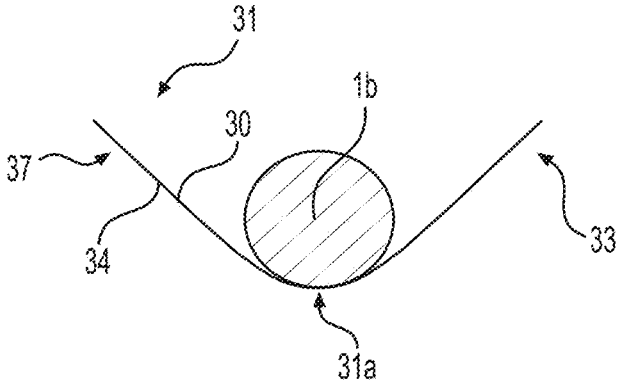
FIG. 15A is an illustration of a cross-sectional view a tobacco rod being bound, in accordance with an example embodiment.

In an example embodiment, once the tobacco column 1*a* and the at least one covering 31 proceed into the finishing (rod forming) section 11, via the force of the lower belt 22, the tobacco column 1*a* is guided through the compression box 100*a* to form a tobacco rod 1*b* (see at least FIG. 15A, which is view A-A of FIG. 1). In an example embodiment, the compression box 100*a* includes a tongue assembly 100 (see at least FIGS. 10A-10D), that is mounted on a lower plate 150 (see at least FIG. 13A), where the compression box 100*a* assists in folding the at least one covering 31 longitudinally around at least a portion of the tobacco rod 1*b* (see FIG. 15A). In an example embodiment, the tobacco rod 1*b* and the at least one covering 31 pass through the compression box 100*a*, prior to coming into contact with an adhesive applicator 40. In an example embodiment, the adhesive applicator 40 applies an adhesive 35 to a free edge 37 of the at least one covering 31 (see FIG. 15B, which is view B-B of FIG. 1), while the at least one covering 31 is partially wrapped around the tobacco rod 1*b*, as explained in more detail herein. In an example embodiment, the adhesive applicator 40 is a glue gun, or another device capable of discharging and applying the adhesive 35 to a sheet of material such as the at least one covering 31. In an example embodiment, the adhesive 35 is a food-safe organic fixative. In an example embodiment, the adhesive 35 is made from plant extract, starch, dextrin, other food-safe adhesives, or combinations thereof.

Figure 14:
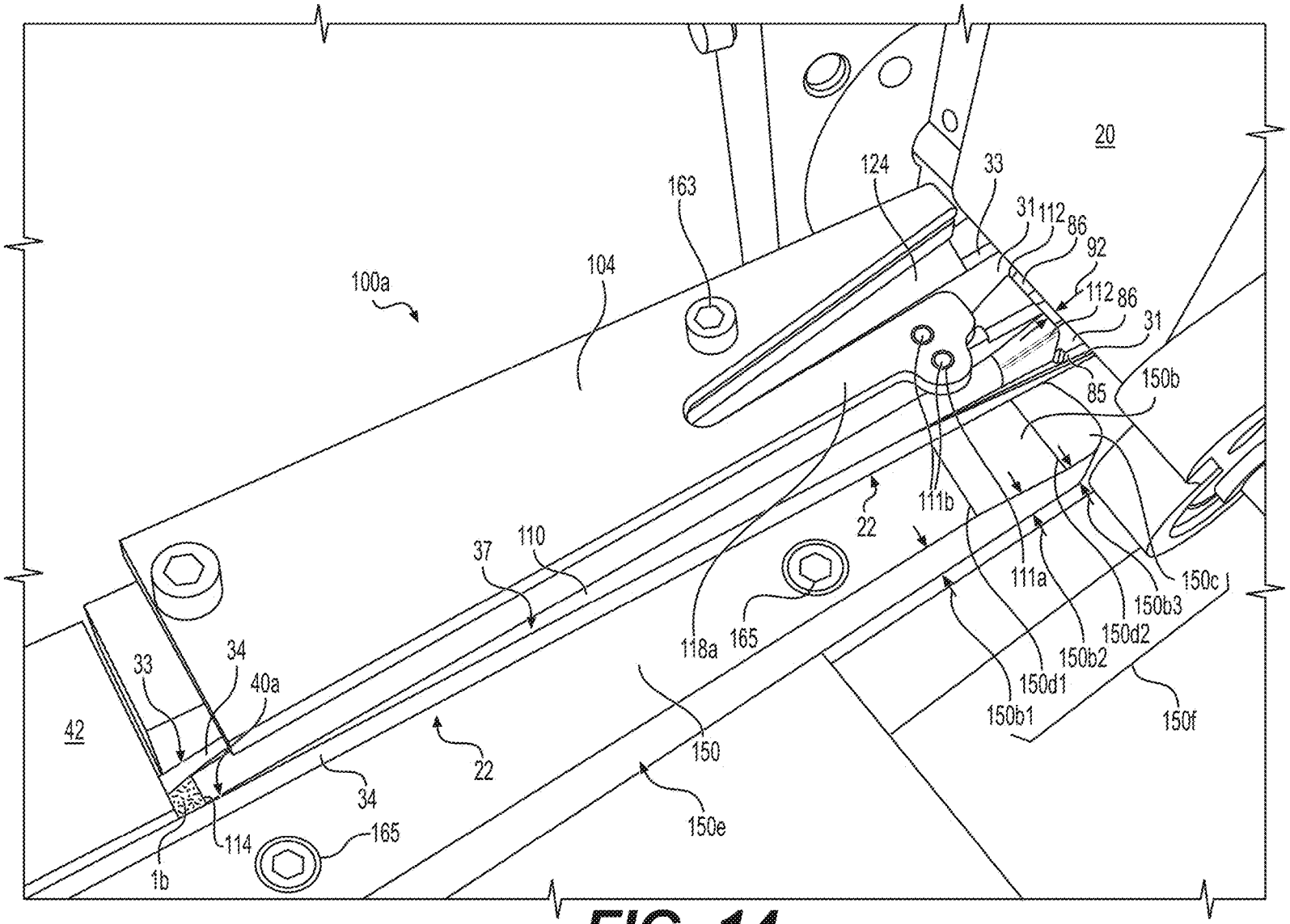
FIG. 14 is an illustration of a perspective view of the tongue assembly of the compression box interfacing with the in-feed section, in accordance with an example embodiment.
Figure 15B:
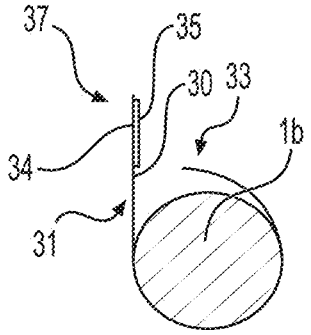
FIG. 15B is another illustration of a cross-sectional view the tobacco rod being bound, in accordance with an example embodiment.
Figure 15C:
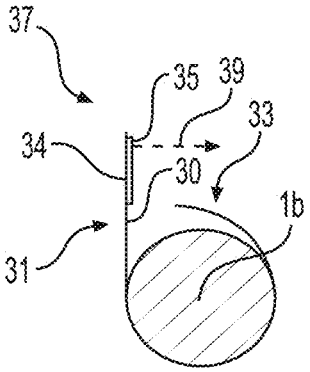
FIG. 15C is another illustration of a cross-sectional view the tobacco rod being bound, in accordance with an example embodiment.
Figure 15D:
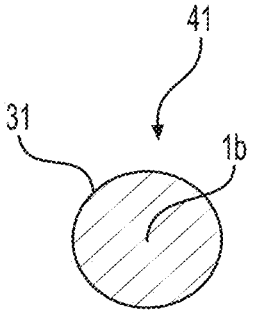
FIG. 15D is another illustration of a cross-sectional view the tobacco rod being bound, in accordance with an example embodiment.

In an example embodiment, the lower belt 22 causes the at least one covering 31 and the tobacco column 1*a* to travel in unison through the compression box 100*a* to a short folder 42, as discussed in more detail herein (see FIG. 14). In an example embodiment, the short folder 42 folds a lap (folded) edge 33 of the at least one covering 31 toward the tobacco rod 1*b*, as shown in FIG. 15B (which is view B-B of FIG. 1). In an example embodiment, the adhesive applicator 40 can located before or after the short folder 42, as depicted in FIG. 1. In an example embodiment, the lower belt 22 causes the at least one covering 31 and the tobacco column 1*a* to then continue to travel through a finishing folder 44 and a heater 46. In an example embodiment, the short folder 42 and/or the finishing folder 44 causes the lap edge 33 of the at least one covering 31 to be pinned down on the tobacco rod 1*b*, while the free edge 37 of the at least one covering 31 is also folded (in direction 39, as shown in FIG. 15C) toward the tobacco rod 1*b* and the lap edge 33 (see FIG. 15C, which is view C-C of FIG. 1). In an example embodiment, the heater 46 applies heat to the at least one covering 31 and the tobacco rod 1*b* to set the adhesive 35. In an example embodiment, following the heater 46, the at least one covering 31 is fused onto the tobacco rod 1*b* (as shown in FIG. 15D, which is view D-D of FIG. 1) to form a finished rod 41.

Figure 16:
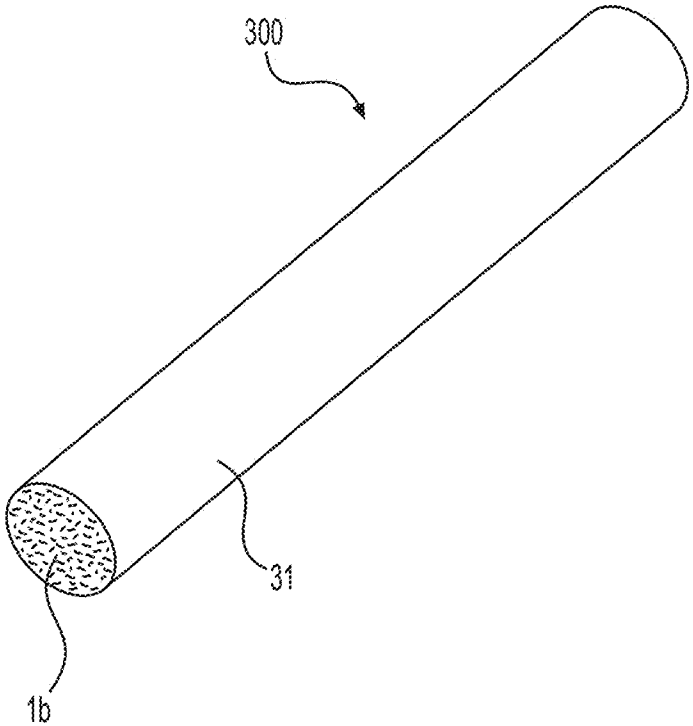
FIG. 16 is an illustration of a consumer product that is made from the rod forming apparatus, in accordance with an example embodiment.

In an example embodiment, the lower belt 22 causes the finished rod 41 to pass through a cutter 48. In an example embodiment, the cutter 48 cuts the finished rod 41 into segments, where these segments form the consumer product 300 (FIG. 16).

FIG. 2 is an illustration of a cross-sectional view of a portion of the feed section 2 of FIG. 1 (from the perspective of view E-E of FIG. 1), in accordance with an example embodiment. In an example embodiment, the first belt section 12*a* of the upper belt 12 rides above a conveyor guide 50. In an example embodiment, the conveyor guide 50 is positioned within a conveyer base plate 52. In an example embodiment, tobacco 1 from the feed section 2 is deposited upon the first belt section 12*a* to form a tobacco column 1*a*. In an example embodiment, the trough 14 keeps the tobacco column 1*a* on the first belt section 12*a* as the tobacco column 1*a* is conveyed to the in-feed section 4 of the rod forming apparatus 10. In an example embodiment, the trough 14 is stabilized and/or mounted onto the conveyor base plate 52 by one or more brackets 54.

Figure 3:
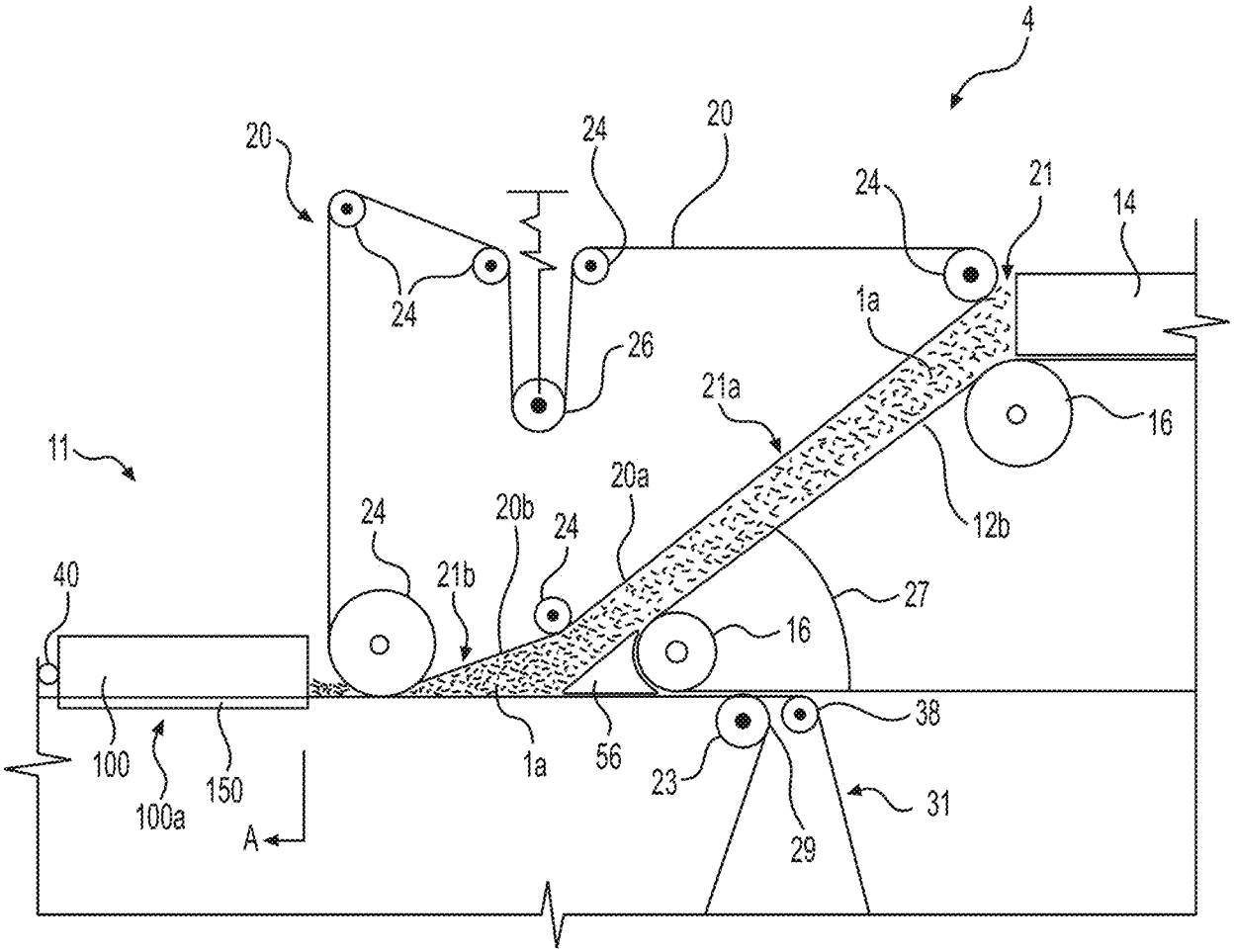
FIG. 3 is an illustration of an enlarged view of an in-feed section and a finishing section of the rod forming apparatus, in accordance with an example embodiment.
Figure 4:
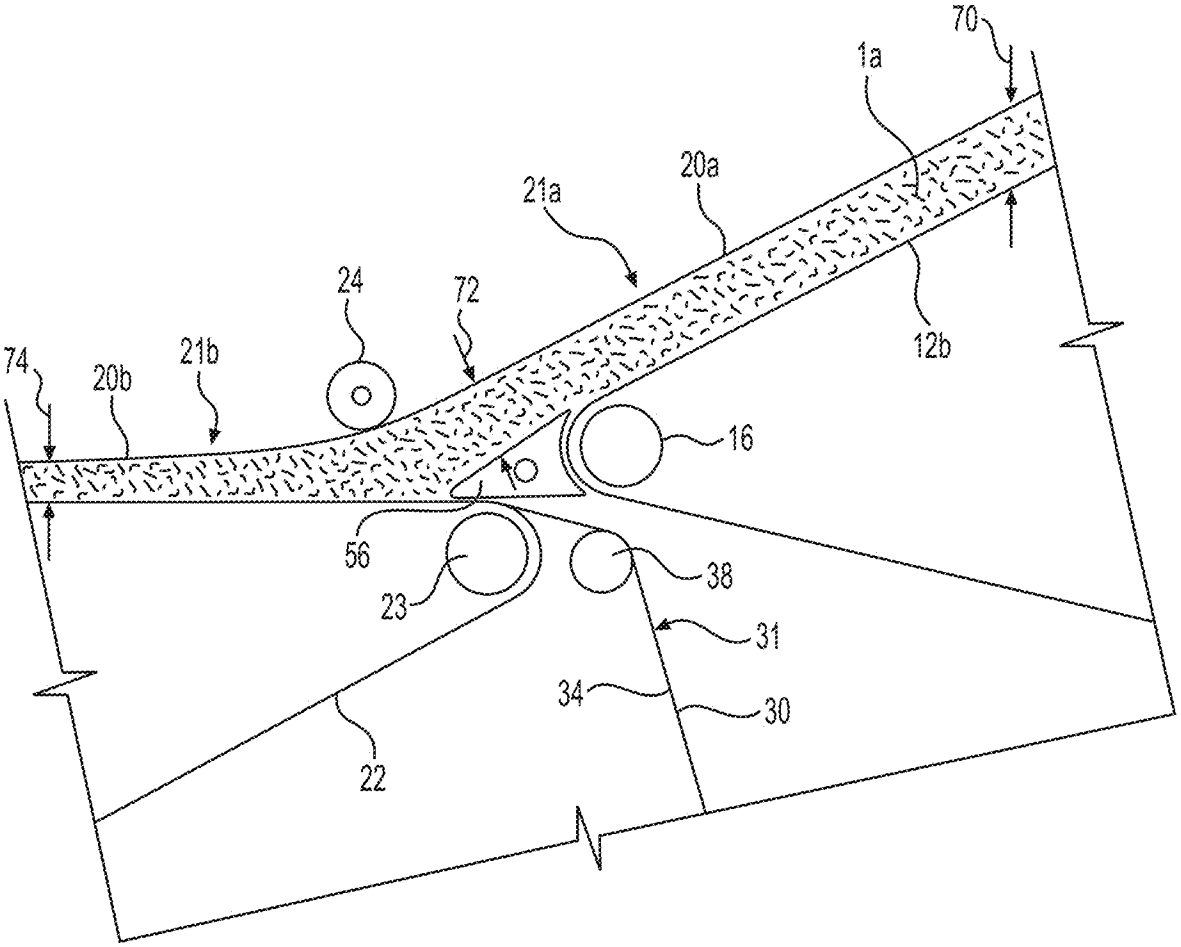
FIG. 4 is an illustration of a portion of the in-feed section of the rod forming apparatus, in accordance with an example embodiment.
Figure 5:
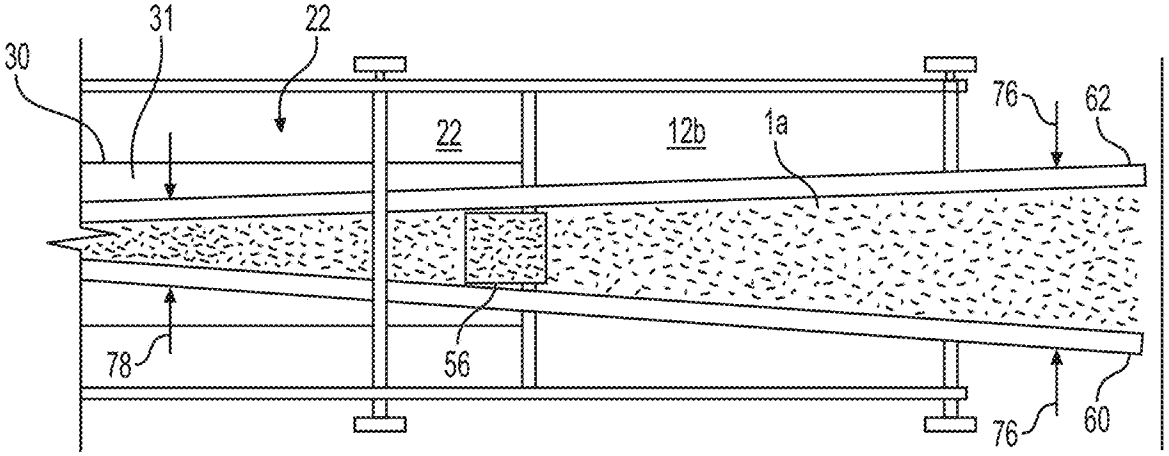
FIG. 5 is an illustration of a top view of a portion of the in-feed section of the rod forming apparatus, in accordance with an example embodiment.

FIG. 3 is an illustration of an enlarged view of the in-feed section 4 and a portion of the finishing section 11 of the rod forming apparatus 10 of FIG. 1, in accordance with an example embodiment. In FIG. 3, the in-feed section 4 is shown without the squeeze bar 60 in position on a side of the channel (in-feed flow path) 21, in order to better understand the in-feed section 4, though it should be understood that the squeeze bar 60 is normally installed in front of the channel 21 during normal operational use of the rod forming apparatus 10. In an example embodiment, a descending section 21*a* of the channel 21 is defined at least in part by the second belt section 12*b*, the descending belt section 20*a*, the first squeeze bar 60 and a second squeeze bar 62 (also see FIGS. 1, 4 and 6). In an example embodiment, the tobacco column 1*a* rides primarily along the second belt section 12*b*, where the descending belt section 20*a* of the in-feed belt 20 also assists in the transport of the tobacco column 1*a* through the descending section 21*a* of the channel 21. In an example embodiment, the descending section 21*a* of the channel 21 has a continually narrowing cross-sectional flow area, as the tobacco column 1*a* descends down to a horizontal section 21*b* of the channel 21, as also depicted in FIGS. 4 and 5. The continually narrowing cross-sectional flow area of the descending section 21*a* of the channel 21 causes the tobacco column 1*a* to be gently and continually compressed.

In an example embodiment, a decline angle 27 of the descending section 21*a* of the channel 21 (defined by the second belt section 12*b* and the descending belt section 20*a*), assists in driving the tobacco column 1*a* through the channel 21 with enough velocity that the tobacco column 1*a* has a necessary momentum to flow through the horizontal section 21*b* of the channel 21 and the compression box 100*a*, where the tobacco column 1*a* is further compressed along the way. To that end, an exceedingly steep decline angle 27 can cause the tobacco column 1*a* to flow at too great of a velocity, causing a potential over-compression of the tobacco column 1*a* (and, subsequent potential "accordion effect," caused by the over-compression), due to any minor disruption or impedance of the flow of the tobacco column 1*a* through the rod forming apparatus 10. An exceedingly mild decline angle 27 can leave the tobacco column 1*a* without enough velocity and momentum to carry the tobacco column 1*a* through the channel 21 and the compression box 100*a*. Therefore, in an example embodiment, the angle of incline 27 is about 10-45 degrees (relative to a horizontal plane, where the horizontal plane is perpendicular to gravity). It should be understood that the decline angle 27 varies, depending for instance on a speed of the second belt section 12*b* and the descending belt section 20*a*, and a composition of the tobacco column 1*a*.

In an example embodiment, the channel 21 is also at least partially defined by the horizontal section 21*b*, where the horizontal section 21*b* feeds the tobacco column 1*a* into the compression box 100*a*. In an example embodiment, the horizontal section 21*b* also has a continually narrowing cross-sectional flow area that causes the tobacco column 1*a* to be further compressed prior to flowing into the compression box 100*a*. In an example embodiment, the horizontal section 21*b* of the channel 21 is defined at least in part by the lower belt 22, the horizontal belt section 20*b*, and horizontal portions 84 of the first squeeze bar 60 and the second squeeze bar 62 (see FIGS. 8A-8D).

In an example embodiment, the in-feed section 4 includes a transition piece 56 that further defines the channel 21. Specifically, in an example embodiment, the transition piece 56 fills a gap (bridges a transition) between the second belt section 12*b* and the lower belt 22, allowing the tobacco column 1*a* to more smoothly flow over the transition piece 56 as the tobacco column 1*a* leaves the second belt section 12*b* and flows onto the lower belt 22. In an example embodiment, the transition piece 56 may serve to reduce a level of turbulence that might otherwise be imparted to the tobacco column 1*a* traversing between the second belt section 12*b* and the lower belt 22. Specifically, in an example embodiment, the transition piece 56 occupies a space at the transition between the upper belt 12 and the lower belt 22, where this space would otherwise allow the tobacco column 1*a* to potentially accumulate and intermittently release, which may impact a consistency of the final consumer product 300.

FIG. 4 is an illustration of a portion of the in-feed section 4 of the rod forming apparatus 10, in accordance with an example embodiment. This view depicts a flow of the tobacco column 1*a*, through a section of the descending section 21*a* and a section of the horizontal section 21*b* of the channel 21. In an example embodiment, the at least one covering 31 is pulled underneath and past the transition piece 56, as the tobacco column 1*a* flows over the transition piece 56 and over a portion of the at least one covering 31 that is directly on the lower belt 22. In an example embodiment, the depth of the tobacco column 1*a* is continually reduced, as the cross-sectional flow area of the channel 21 continues to narrow along a length of the channel 21. Specifically, in an example embodiment, an initial depth 70 of the tobacco column 1*a*, which is defined by a distance between the second belt section 12*b* and the descending belt section 20*a* toward a beginning of the descending section 21*a* of the channel 21, is reduced down to a smaller depth 72 (adjacent to the transition piece 56) as a distance between the second belt section 12*b* and the descending belt section 20*a* continually narrows along the descending section 21*a* of the channel 21. The depth 74 of the tobacco column 1*a* is even further reduced, due to an even smaller gap between the horizontal belt section 20*b* and the lower belt 22, as the tobacco column 1*a* flows through an end of the horizontal section 21*b* of the channel 21 just prior to the tobacco column 1*a* being discharged into the compression box 100*a*.

In an example embodiment, a speed of travel of the upper belt 12 matches a speed of travel of the in-feed belt 20. In an example embodiment, a speed of travel of the lower belt 22 matches the speed of travel of the upper belt 12 and the in-feed belt 20.

FIG. 5 is an illustration of a top (cut-away) view of a portion of the in-feed section 4 of the rod forming apparatus 10, in accordance with an example embodiment. In this top view, a relationship is depicted between the first squeeze bar 60, the second squeeze bar 62, the second belt section 12*b* and the lower belt 22. In an example embodiment, an initial width 76 between the first squeeze bar 60 and the second squeeze bar (near a proximal end of the squeeze bars 60/62) is narrowed to a smaller width 78 (near a distal end of the squeeze bars 60/62). In an example embodiment, the squeeze bars 60/62 are positioned so that the width between the squeeze bars 60/62 is continually decreasing, just as a depth of the tobacco column 1*a* (from depth 70, to depth 74, shown in FIG. 4) is continually decreasing. This causes the tobacco column 1*a* to gradually and continually become compressed, as the tobacco column 1*a* flows through the descending section 21*a* and the horizontal section 21*b* of the channel 21 (also see FIG. 4).

In an example embodiment, the at least one covering 31 comes into intimate direct contact with the tobacco column 1*a*, as the at least one covering 31 moves under and past the transition piece 56 and the tobacco column 1*a* moves over and past the transition piece 56. In an example embodiment, the lower belt 22 is directly below the at least one covering 31 (obscured from view in FIG. 5), where the lower belt 22 also passes under the transition piece 56.

Figure 6:
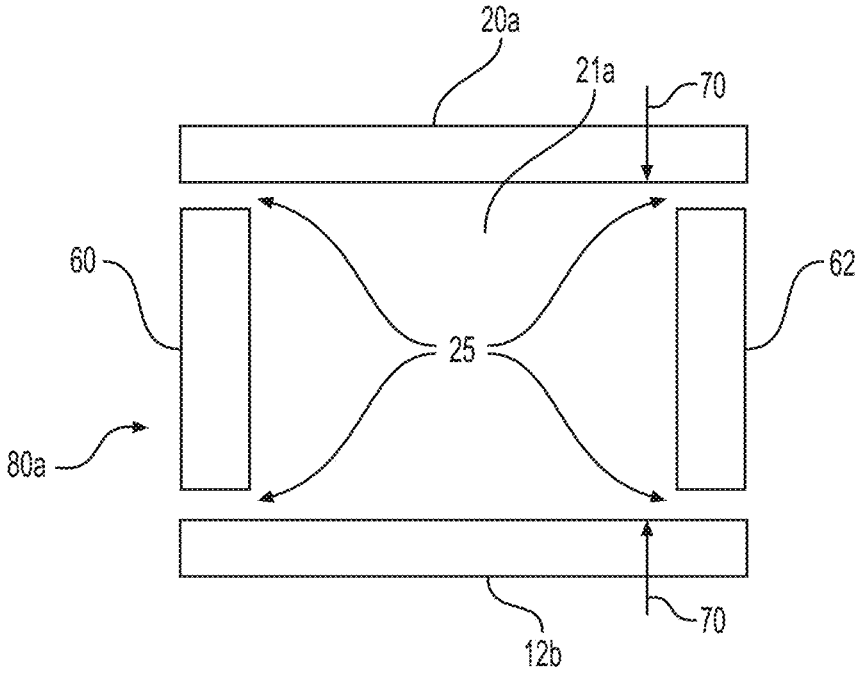
FIG. 6 is an illustration of a channel of the in-feed section of the rod forming apparatus, in accordance with an example embodiment.

FIG. 6 is an illustration of a cross-sectional view (view F-F of FIG. 1) of the descending section 21*a* of the channel 21 of the in-feed section 4 of the rod forming apparatus 10, in accordance with an example embodiment. Specifically, this view is toward a proximal end 80*a* of a main shaft 80 of the squeeze bars 60/62 (see at least FIG. 8B). In an example embodiment, and at this location of the descending section 21*a* of the channel 21 (see FIGS. 3 and 4), a depth 70 of the tobacco column 1*a* is relatively large due to a large gap between the second belt section 12*b* and the descending belt section 20*a*, and the squeeze bars 60/62 are relatively far apart from each other such that a major portion of the descending belt section 20*a* and a major portion of the second belt section 12*b* contact the tobacco column 1*a* thereby assisting the tobacco column 1*a* in being conveyed down to the horizontal section 21*b* of the channel 21. In an example embodiment, gaps 25 exist in the descending section 21*a* of the channel 21 to provide a small clearance to allow the descending belt section 20*a* and the second belt section 12*b* to move past the squeeze bars 60/62.

Figure 7:
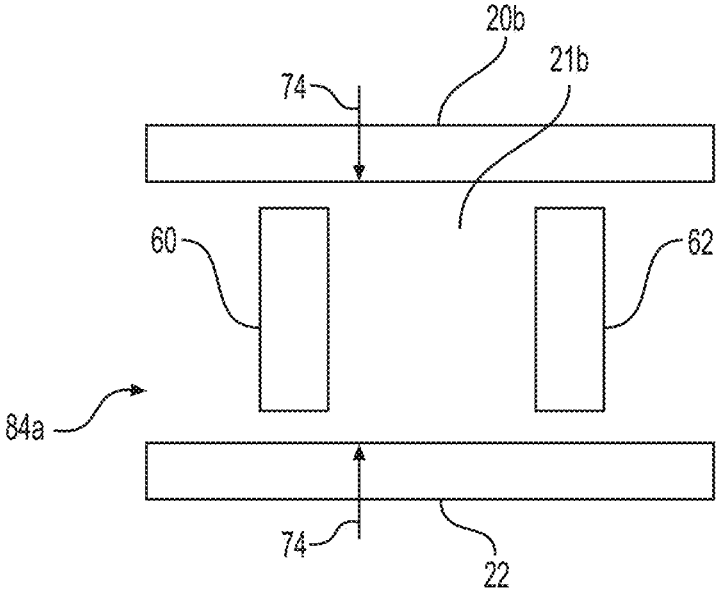
FIG. 7 is another illustration of the channel of the in-feed section of the rod forming apparatus, in accordance with an example embodiment.

FIG. 7 is another illustration of a cross-sectional view (view G-G of FIG. 1) of the horizontal section 21*b* of the channel 21 of the in-feed section 4 of the rod forming apparatus 10, in accordance with an example embodiment. In an example embodiment, and at this location of the horizontal section 21*b* of the channel 21 (see FIGS. 3 and 4), the squeeze bars 60/62 are relatively close together, thereby assisting in the compression of the tobacco column 1*a*, as the depth 74 of the tobacco column 1*a* is also depressed by the narrowing gap between the horizontal belt section 20*b* and the lower belt 22 (see FIG. 4). In an example embodiment, the gaps 25 exist in the horizontal section 21*b* of the channel 21 to provide a small clearance to allow the horizontal belt section 20*b* and the lower belt 22 to move past the squeeze bars 60/62.

Figure 8A:
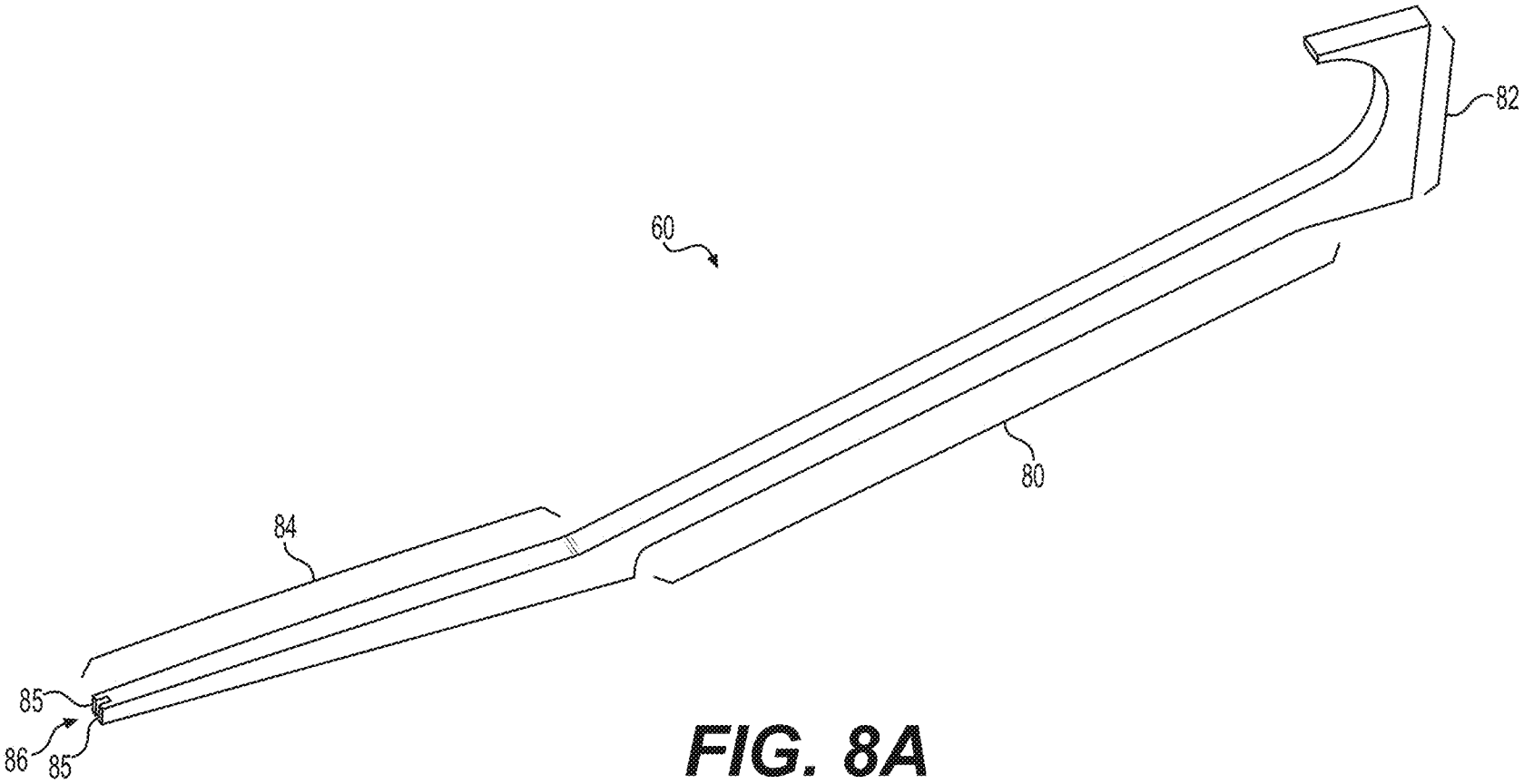
FIG. 8A is an illustration of a perspective view of a squeeze bar, in accordance with an example embodiment.

FIG. 8A is an illustration of a perspective view of the first (outer) squeeze bar 60, in accordance with an example embodiment. In an example embodiment, the first squeeze bar 60 includes a hook 82 on a proximal end of the first squeeze bar 60, and a horizontal portion 84 on a distal end of the first squeeze bar 60. In an example embodiment, the first squeeze bar 60 includes a main shaft 80 that slopes at an angle, between the hook 82 and the horizontal portion 84. In an example embodiment, a general shape of the first squeeze bar is conformed to a general shape of the channel 21, as shown in FIGS. 3 and 4.

In an example embodiment, the hook 82 can be a different shape than what is shown in FIG. 8A. In an example embodiment, the hook 82 is capable of fitting around, and being stabilized by a roller 24 (as shown in FIGS. 1 and 3). In an example embodiment, a tip 86 of the first squeeze bar 60 includes at least one protrusion (prong) 85 extending from the tip 86 (see also FIG. 8C).

Figure 8B:
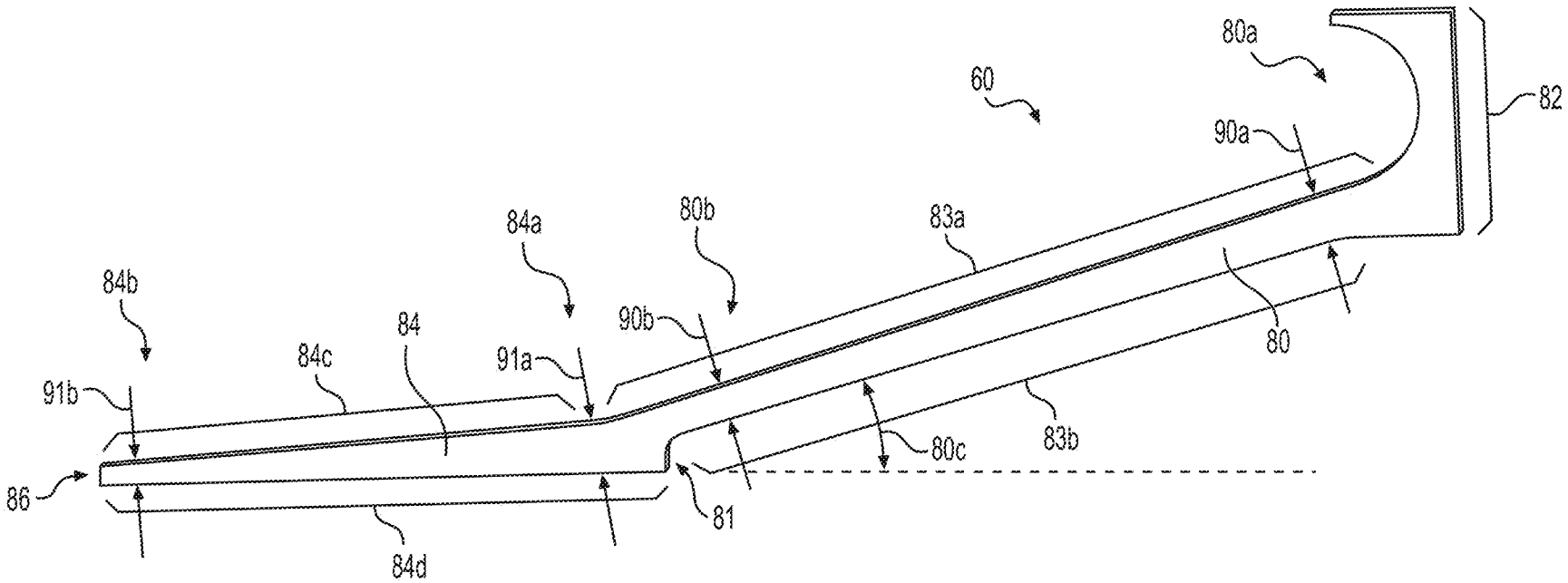
FIG. 8B is an illustration of a side view of the squeeze bar, in accordance with an example embodiment.

FIG. 8B is an illustration of a side view of the first squeeze bar 60, in accordance with an example embodiment. In an example embodiment, a depth 90*a* of the main shaft 80, at a proximal end 80*a* of the main shaft 80, is larger than a depth 90*b* of a distal end 80*b* of the main shaft 80. In an example embodiment, the depth of the main shaft 80 continues to decrease along a longitudinal length of the main shaft 80, from the proximal end 80*a* to the distal end 80*b*. In an example embodiment, a length of an upper surface 83*a* of the main shaft 80 is longer than a length of a lower surface 83*b* of the main shaft 80.

In an example embodiment, a depth 91*a* of the horizontal portion 84, at a proximal end 84*a* of the horizontal portion 84, is larger than a depth 91*b* of a distal end 84*b* of the horizontal portion 84. In an example embodiment, the depth of the horizontal portion 84 continues to decrease along a longitudinal length of the horizontal portion 84, from the proximal end 84*a* to the distal end 84*b*. In an example embodiment, a length of an upper surface 84*c* of the horizontal portion 84 is shorter than a length of a lower surface 84*d* of the horizontal portion 84. In an example embodiment, a step 81 divides the lower surface 84*d* of the horizontal portion 84 from the lower surface 83*b* of the main shaft 80. In an example embodiment, the lower surface 84*d* is substantially flat.

In an example embodiment, the main shaft 80 has an incline angle 80*c* that is about 10-45 degrees, relative to the lower surface 84*d* of the horizontal portion 84. In an example embodiment, the incline angle 80*c* matches the decline angle 27 the descending section 21*a* of the channel 21 (defined by the second belt section 12*b* and the descending belt section 20*a*, as shown in FIG. 3).

Figure 8C:
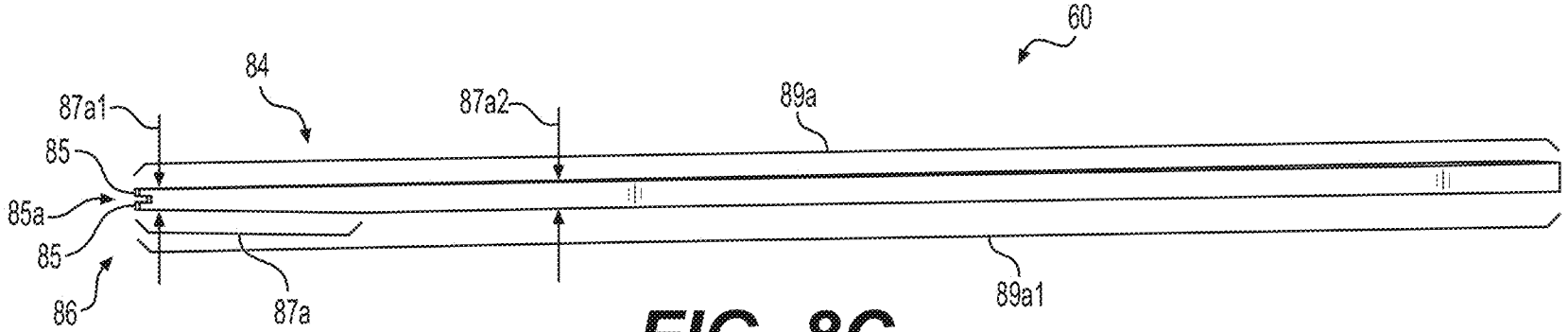
FIG. 8C is an illustration of a top view of the squeeze bar, in accordance with an example embodiment.

FIG. 8C is an illustration of a top view of the first squeeze bar 60, in accordance with an example embodiment. In an example embodiment, an inner surface 89*a* of the first squeeze bar 60 is substantially flat. In an example embodiment, an outer surface 89*a*1 is substantially flat, other than a distal end of the horizontal portion 84 that includes an angled offset 87*a*. In an example embodiment, a thickness 87*a*1 of the distal end of the horizontal portion 84 is smaller than a thickness 87*a*2 of the remainder of the first squeeze bar 60. In an example embodiment, the inner surface 89*a* of the first squeeze bar 60 contacts the tobacco column 1*a*, once the first squeeze bar 60 is installed on the rod forming apparatus 10.

In an example embodiment, the tip 86 on the distal end of the horizontal portion 84 includes two protrusions 85 that form a notch 85*a*. In an example embodiment, only one protrusion 85 exists on the distal end of the horizontal portion 84, where the protrusion 85 extends from the inner surface 89*a* of the first squeeze bar 60. In an example embodiment, the tip 86 does not include protrusions 85.

Figure 8D:
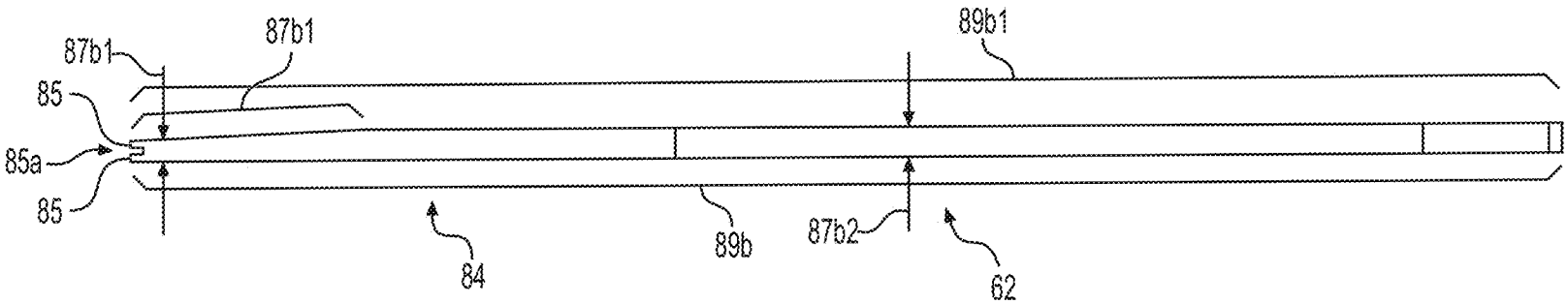
FIG. 8D is an illustration of a top view of another squeeze bar, in accordance with an example embodiment.

FIG. 8D is an illustration of a top view of the second squeeze bar 62, in accordance with an example embodiment. In an example embodiment, the second squeeze bar 62 is a mirror-image of the first squeeze bar 60. Therefore, in an example embodiment, an inner surface 89*b* of the second squeeze bar 62 is substantially flat. In an example embodiment, an outer surface 89*b*1 is substantially flat, other than a distal end of the horizontal portion 84 that includes an angled offset 87*b*. In an example embodiment, a thickness 87*b*1 of the distal end of the horizontal portion 84 is smaller than a thickness 87*b*2 of the remainder of the second squeeze bar 62. In an example embodiment, the inner surface 89*b* of the second squeeze bar 62 contacts the tobacco column 1*a*, once the second squeeze bar 62 is installed on the rod forming apparatus 10.

In an example embodiment, the second (inner) squeeze bar 62 opposes the first (outer) squeeze bar 60 in the rod forming apparatus 10, as shown in at least FIGS. 5-7.

Figure 9A:
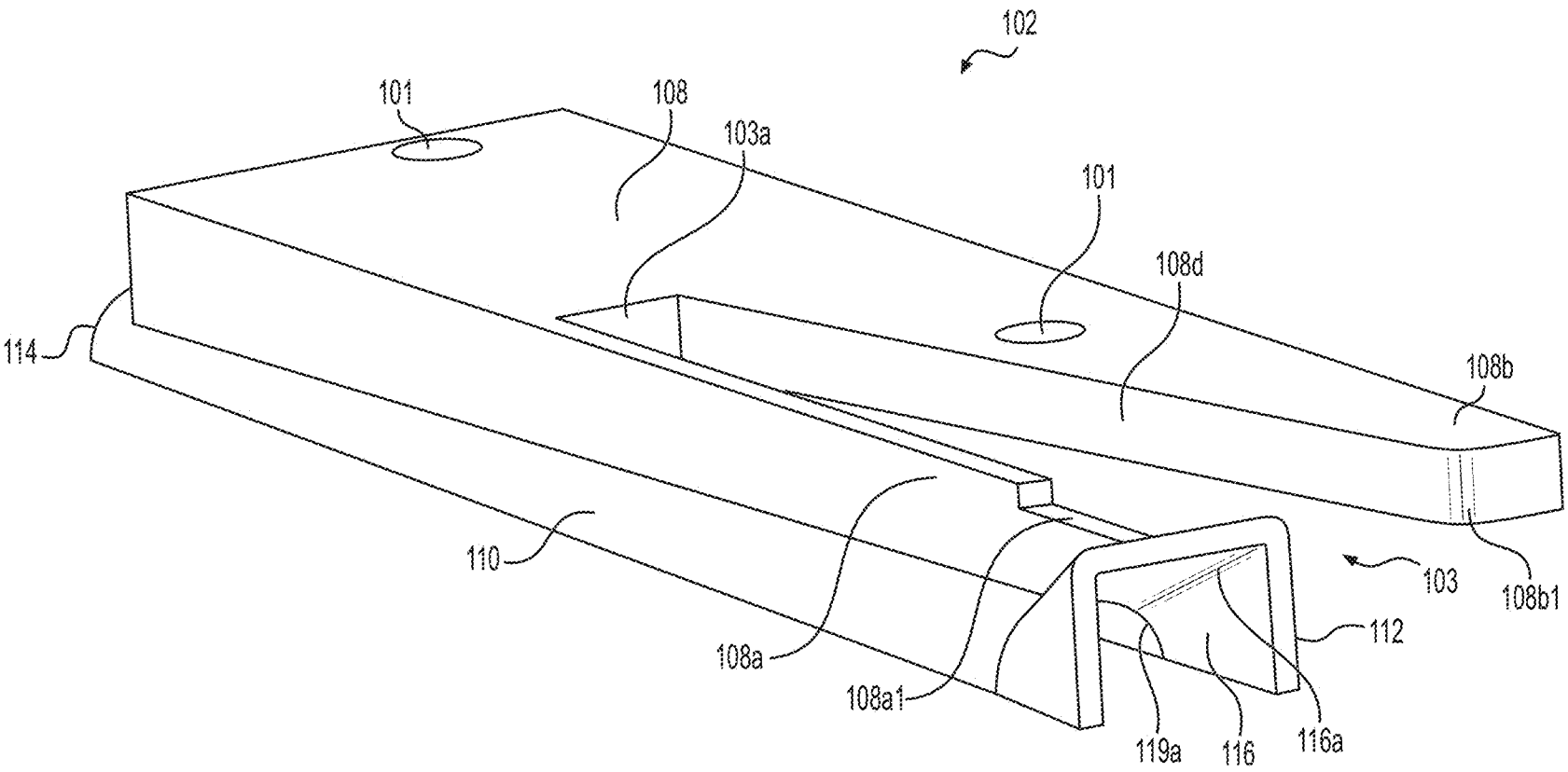
FIG. 9A is an illustration of an upper, front perspective view of a tongue, in accordance with an example embodiment.

FIG. 9A is an illustration of an upper, front perspective view of a tongue 102, in accordance with an example embodiment. In an example embodiment, the tongue 102 is an element of the compression box 100*a*, as explained in more detail herein. In an example embodiment, the tongue 102 includes a shaft 110 that is mounted to an upper plate (capture plate) 108. In an example embodiment, the upper plate 108 includes a first protrusion 108*a* and a second protrusion 108*b* that define a notch 103 on an end of the tongue 102. In an example embodiment, the first protrusion 108*a* and the second protrusion 108*b* are on a same side of the upper plate 108. In an example embodiment, the first protrusion 108*a* is peninsula-shaped, and the second protrusion 108*b* is triangular-shaped (when viewed from above). In an example embodiment, the notch 103 is substantially V-shaped, with a flattened vertex (flattened inner surface 103*a*). In an example embodiment, the first protrusion 108*a* includes a step portion 108*a*1 that adjacent to, and connects with, an inlet 112 of the shaft 110. In an example embodiment, the shaft 110 is mounted onto the upper plate 108 by virtue of the first protrusion 108*a* being connected to the shaft 110, where the first protrusion 108*a* runs along a portion of a longitudinal length of the shaft 110. In an example embodiment, the second protrusion 108*b* includes a beveled (smoothed) front corner 108*b*1 that allows the at least one covering 31 to pass along without damaging the at least one covering 31, as explained in more detail herein. In an example embodiment, the upper plate 108 includes the flat inner surface 103*a* that helps define the notch 103.

Figure 9B:
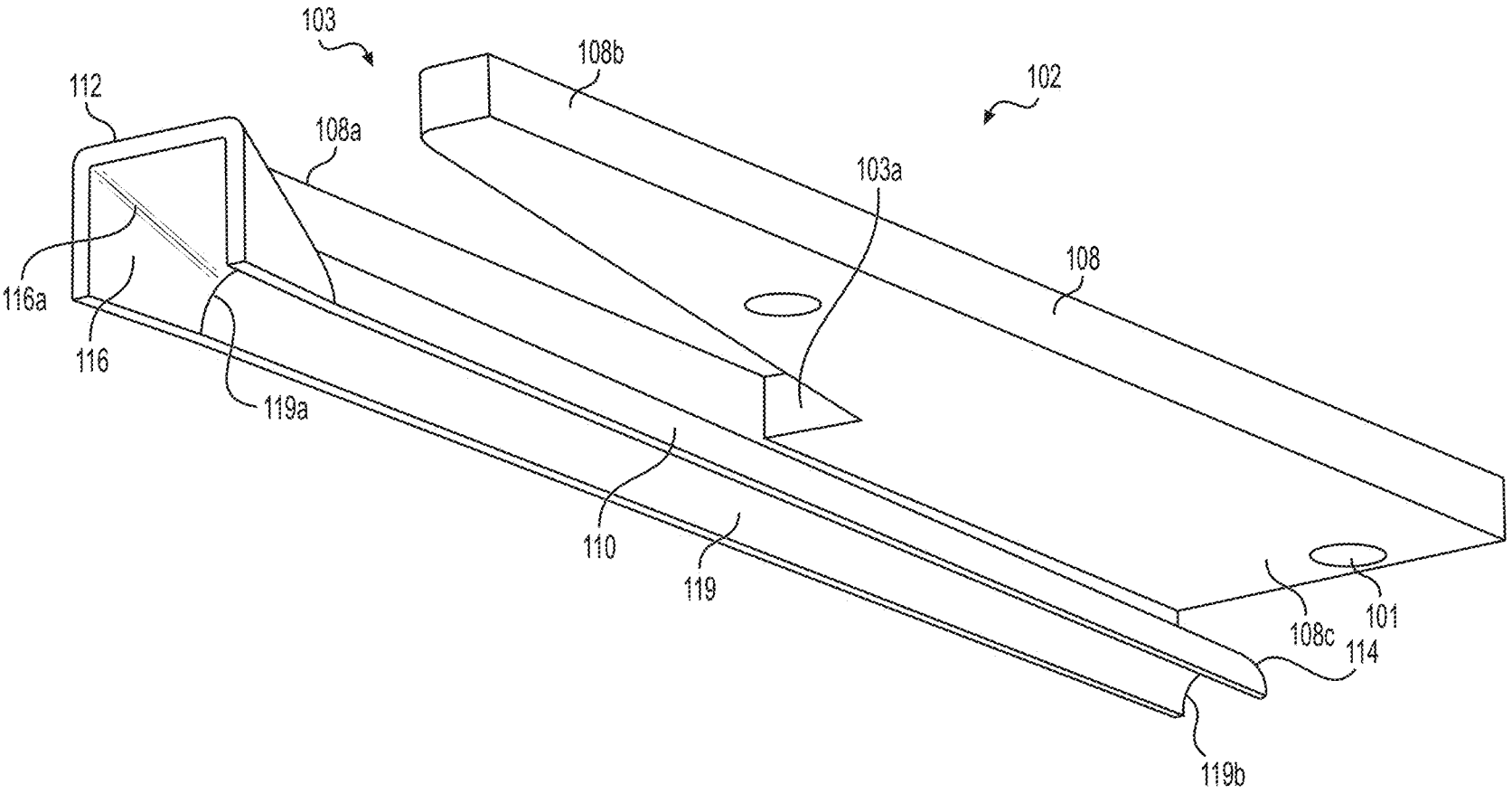
FIG. 9B is an illustration of a lower, front perspective view of the tongue, in accordance with an example embodiment.
Figure 9C:
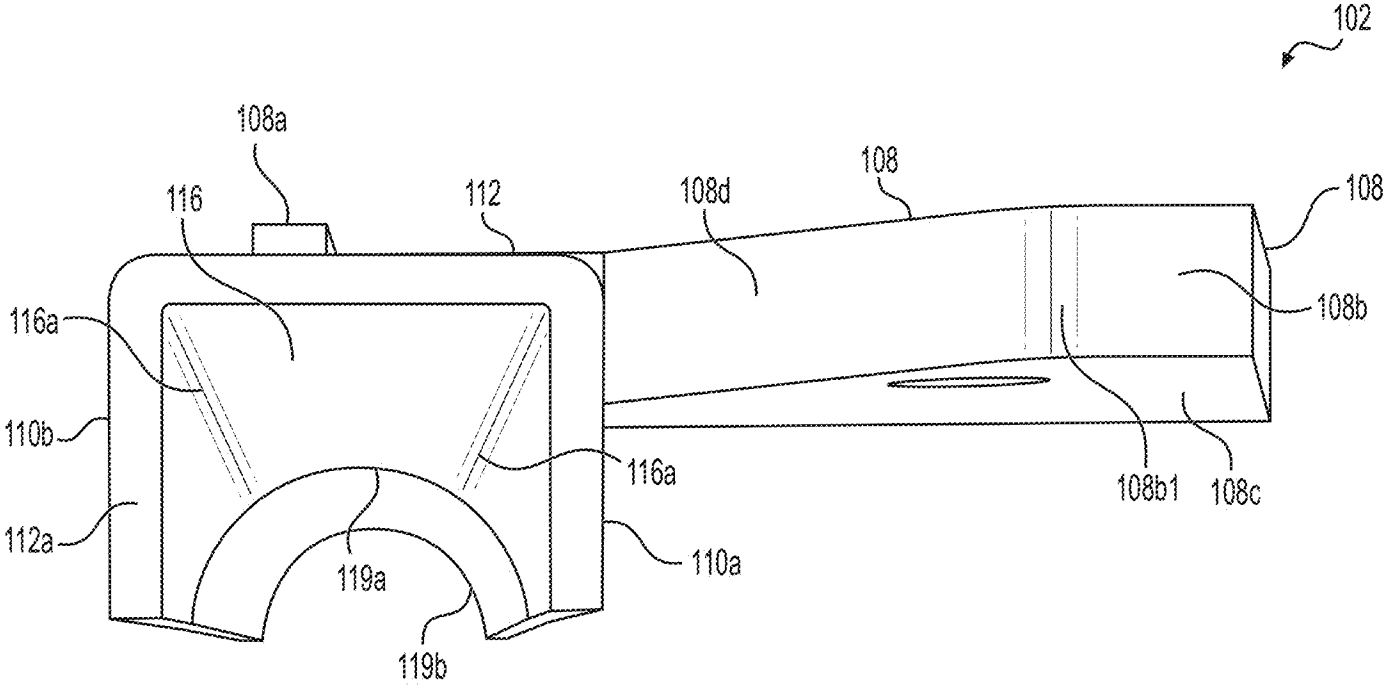
FIG. 9C is an illustration of a front view of the tongue, in accordance with an example embodiment.

In an example embodiment, the shaft 110 is hollow, and is in the shape of a half-pipe (semi-cylindrical shape), as shown better detail in at least FIGS. 9B and 9C. In an example embodiment, other shapes of the shaft 110 are contemplated. In an example embodiment, the shaft 110 includes the inlet 112. In an example embodiment, the inlet 112 is substantially U-shaped, where the inlet 112 forms a substantially square-shaped or rectangular-shaped opening for the tobacco column 1*a* to enter. Other inlet 112 shapes are contemplated. In an example embodiment, the inlet 112 includes a tapered entrance 116. In an example embodiment, the tapered entrance 116 tapers down to an inner inlet 119*a* that is arcuate-shaped. In an example embodiment, the tapered entrance 116 includes one or more lead-ins (creases) 116*a* in the tapered entrance 116. In an example embodiment, the shaft 110 includes an outlet 114.

In an example embodiment, a longitudinal length of the shaft 110 of the tongue 102 is relatively short. In an example embodiment, the relatively short longitudinal length of the shaft 110 reduces a potential "accordion effect" that can occur when pockets of less compressed tobacco, in the tobacco rod 1*b*, and become compressed together at high speeds, during use of the rod forming apparatus 10. In an example embodiment, the longitudinal length of the shaft 110, from the inlet 112 to the outlet 114, is about 10-18 cm, or about 11-15 cm, or about 12.7 cm.

In an example embodiment, the upper plate 108 includes one or more bolt holes 101 that are used to mount the tongue 102. In an example embodiment, the one or more bolt holes 101 includes two bolt holes 101, where at least one of the bolt holes 101 traverses through the second protrusion 108*b*. In an example embodiment, the one or more bolt holes 101 is located on a side (half) of the upper plate 108 that is opposite the location of the shaft 110. In an example embodiment, the inner surface of the one or more bolt holes 101 define threads capable of mating with mounting bolts. In another example embodiment, the inner surface of the one or more bolt holes 101 is a smooth surface devoid of threads.

FIG. 9B is an illustration of a lower, front perspective view of the tongue 102, in accordance with an example embodiment. In an example embodiment, the shaft 110 has an inner surface 119 that is arcuate-shaped, and runs along the longitudinal length of the shaft 110. In an example embodiment, the inner surface 119 faces away from the upper plate 108. In an example embodiment, the inner inlet 119*a* has a first radius of curvature that is larger than a second radius of curvature of an outlet 119*b*, where the outlet 119*b* is arcuate-shaped. That is to say, the inner inlet 119*a* is larger (with a bigger cross-sectional flow area), as compared to the outlet 119*b*. This causes the tobacco column 1*a* to continue to become compressed as it flows through the compression box 100*a*. In an example embodiment, the inner surface 119 of the shaft 110 has a continually decreasing radius of curvature, from the inner inlet 119*a* to the outlet 119*b*.

In an example embodiment, the tapered entrance 116 and the inner surface 119 of the shaft 110 are made from a food-safe plastic or polymer material. In an example embodiment, the tapered entrance 116 and the inner surface 119 of the shaft 110 are made from a polyether ether ketone (PEEK). In an example embodiment, the tongue 102 is made from a food-safe plastic or polymer material, or a polyether ether ketone (PEEK).

In another example embodiment, the shaft 110, or the inner surface 119 of the shaft 110 and the tapered entrance 116, or the overall tongue 102, or the portions of the tongue 102 that contact the tobacco rod 1*b* and/or the at least one covering 31, are made from a metal, such as stainless steel or carbon steel. In this example embodiment, the inner surface 119 of the shaft 110 and the tapered entrance 116, or the overall tongue 102, or the portions of the tongue 102 that contact the tobacco rod 1*b* and/or the at least one covering 31, are made from metal that may be coated with a food-safe coating. In an example embodiment, the food-safe coating is made from a food-safe plastic or polymer material, or a polyether ether ketone (PEEK).

In an example embodiment, a majority of a lower surface 108*c* of the upper plate 108 is substantially flat.

FIG. 9C is an illustration of a front view of the tongue 102, in accordance with an example embodiment. In an example embodiment, a rim 112*a* of the inlet 112 of the tongue 102 fits into the notch 85*a* of the first squeeze bar 60 and the second squeeze bar 62, thereby stabilizing the tip 86 of the horizontal portion 84 of each of the squeeze bars 60/62 (see FIG. 14). In another example embodiment, where the squeeze bars 60/62 include only a single protrusion 85, the single protrusion 85 of each squeeze bar 60/62 may fit along the tapered entrance 116 of the inlet 112 of the tongue 102, such that the single protrusion 85 contacts an inner edge of the rim 112*a* of the inlet 112. In another example embodiment, where the squeeze bars 60/62 do not include a protrusion 85, the tip 86 of the squeeze bars 60/62 abut the rim 112*a* of the inlet 112 of the tongue 102.

In an example embodiment, during use of the rod forming apparatus 10, the lap edge 33 of the at least one covering 31 (see at least FIG. 15A) travels along a first outer side surface 110*a* of the shaft 110, and a free edge 37 of the at least one covering 31 travels along a second outer surface 110*b* of the shaft 110, while the tobacco column 1*a* enters the inlet 112 of the tongue 102, and the tobacco column 1*a* is formed into a tobacco rod 1*b* as the tobacco flows past the inner inlet 119*a* (see at least FIG. 15A, which is view A-A of FIG. 1). As the tobacco rod 1*b* flows through the tongue 102, the tobacco rod 1*b* becomes further compressed prior to exiting the tongue 102. In an example embodiment, as the at least one covering 31 passes along the tongue 102, the lap edge 33 may contact an angled surface 108*d* of the upper plate 108 (depending on a width of the at least one covering 31), as the at least one covering 31 becomes partially folded around the lower portion of the tobacco rod 1*b* that is formed in the tongue 102 (see FIG. 15A).

Figure 10A:
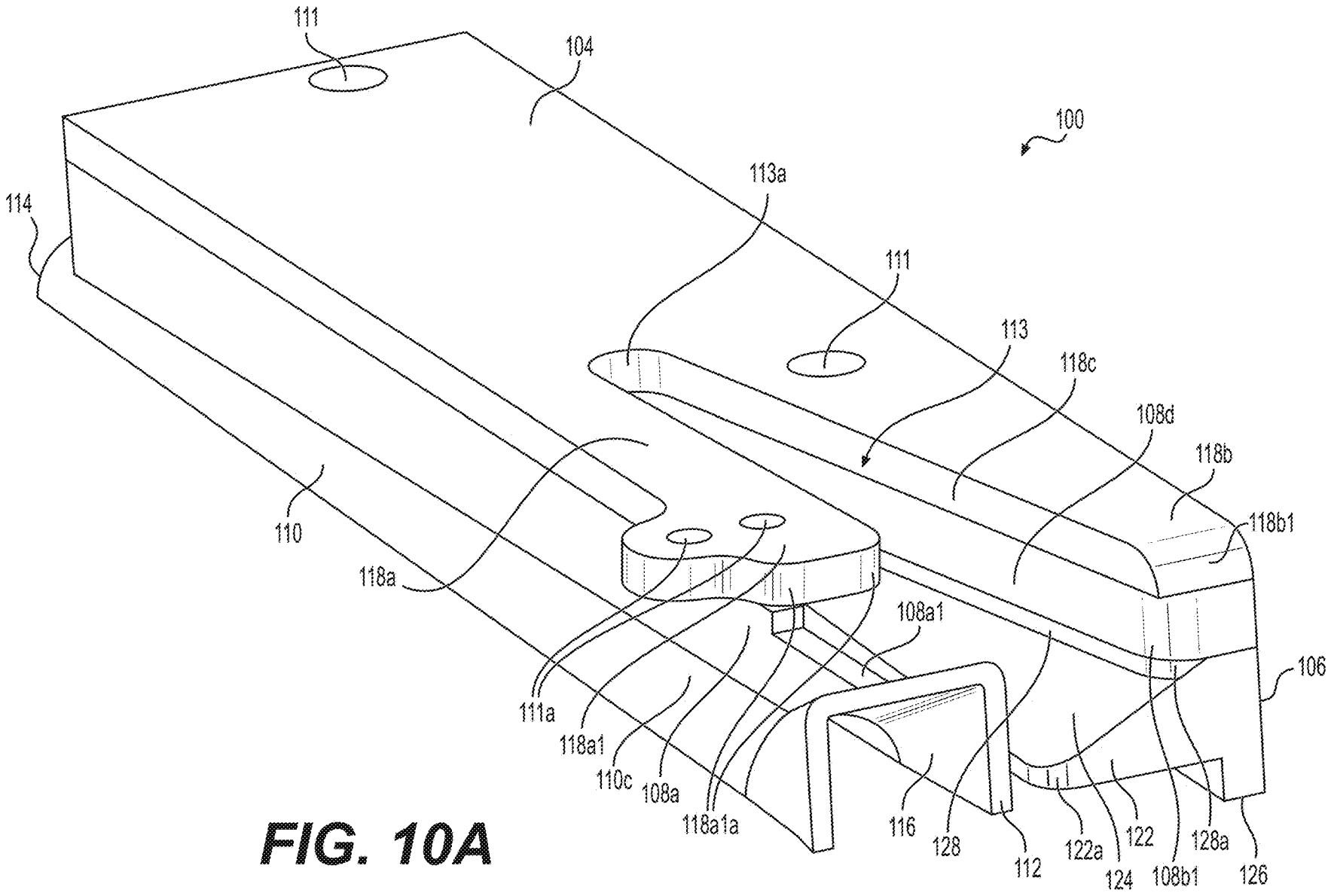
FIG. 10A is an illustration of an upper, front perspective view of a tongue assembly, in accordance with an example embodiment.

FIG. 10A is an illustration of an upper, front perspective view of the tongue assembly 100, in accordance with an example embodiment. In an example embodiment, the tongue assembly 100 includes an upper mounting plate 104 and a lower mounting plate 106 (seen in better detail in FIGS. 11A and 11B), capable of being connected above and below the tongue 102. In an example embodiment, the upper mounting plate 104 includes mounting bolt holes 111 that align with the mounting bolt holes 101 of the tongue 102, one or more mounting bolt holes 131 in the lower mounting plate 106 (FIG. 10C), and one or more mounting bolt holes 164 in the lower plate 150 (FIG. 13C) of the compression box 100*a* (see FIG. 13A). In an example embodiment, the upper mounting plate 104 includes two mounting bolt holes 111, or more than two mounting bolt holes 111, that mate with bolt holes in the upper plate 108 of the tongue 102 and the lower mounting plate 106. In an example embodiment, the upper mounting plate 104 includes mounting bolt holes 111, used for the purpose of mounting the tongue assembly 100 onto the lower plate 150 of the compression box 100*a*, where the mounting bolt holes 111 are located on a side (half) of the tongue assembly 100 that is opposite the location of the shaft 110.

In an example embodiment, the upper mounting plate 104 includes a first protrusion 118*a* and a second protrusion 118*b* that define a notch 113. In an example embodiment, the notch 113 substantially matches a shape of the notch 103 (FIG. 9A) of the upper plate 108 of the tongue 102, where the notch 113 and notch 103 substantially align with each other once the tongue assembly 100 is assembled. In an example embodiment, the notch 113 is substantially V-shaped, with a rounded vertex (curved inner surface 113*a*). In an example embodiment, the first protrusion 118*a* is substantially peninsula-shaped and the second protrusion 118*b* is substantially triangular-shaped (when viewed from above). In an example embodiment, the upper mounting plate includes the curved inner surface 113*a* on an inner portion of the notch 113.

In an example embodiment, the first protrusion 118*a* includes an enlarged end portion 118*a*1. In an example embodiment, the first protrusion 118*a* includes one or more bolt holes 111*a*. In an example embodiment, the one or more bolt holes 111*a* straddle sides of the first protrusion 108*a* of the tongue 102, so that bolts 111*b* (FIG. 13A) can be screwed into the one or more bolt holes 111*a*, where distal ends of the bolts 111*b* can contact an upper surface 110*c* of the shaft 110 to help stabilize the upper mounting plate 104 on the tongue 102 (see FIG. 13A). In an example embodiment, the inner surface of the one or more bolt holes 111*a* define threads capable of mating with the bolts 111*b*. In an example embodiment, a front surface of the enlarged end portion 118*a*1 of the first protrusion 118*a* includes one or more beveled corners 118*a*1*a*.

In an example embodiment, the second protrusion 118*b* includes a beveled (smoothed) front surface 118*b*1. In an example embodiment, the second protrusion 118*b* includes an angled surface 118*c* that substantially aligns with the angled surface 108*d* of the tongue 102.

In an example embodiment, the lower mounting plate 106 includes a shelf 122 that extends from an inner side of the lower mounting plate 106 toward the shaft 110 of the tongue 102. In an example embodiment, the shelf 122 includes an inclined surface 124 that is upwardly facing, and extends toward an end surface 106*a* of the lower mounting plate 106 (shown in better detail in FIG. 11B). In an example embodiment, the inclined surface 124 inclines away from the shaft 110, and inclines toward the side surface (inner side surface) 130 of the lower mounting plate 106. In an example embodiment, the shelf 122 includes a front corner 122*a* that is beveled (rounded), and faces the inlet 112 of the shaft 110 of the tongue 102. In an example embodiment, the lower mounting plate 106 includes an angled surface 128 that extends above the inclined surface 124. In an example embodiment, the angled surface 128 is conformed to generally align with the angled surface 108*d* of the tongue 102 and the angled surface 118*c* of the upper mounting plate 104. In an example embodiment, the angled surface 128 includes a beveled (rounded) front corner 128*a*.

In an example embodiment, a protrusion 126 extends from a lower end of the lower mounting plate 106. In an example embodiment, the protrusion 126 runs along a longitudinal length of the lower mounting plate 106, and assists in allowing the lower mounting plate 106 and the tongue assembly 100 to be correctly aligned and mounted onto the lower plate 150 of the compression box 100*a* (see FIG. 13A).

In an example embodiment, the overall height of the tongue assembly 100 is substantially uniform, such that the tongue assembly 100 is substantially flat when installed on the rod forming apparatus 10. Said another way, when the tongue assembly 100 is installed on the rod forming apparatus 10, the top surface of the upper mounting plate 104 is substantially flat, and the general height of the tongue assembly 100 (from the lower surface 132 of the lower mounting plate 106 to the upper surface of the upper mounting plate 104) is substantially uniform, along a length of the tongue assembly 100.

In an example embodiment, the upper mounting plate 104 is used to support and protect the tongue 102 from deformation and/or warping during use in the rod forming apparatus 10, especially if the shaft 110, or the overall tongue 102, is made from a material other than metal.

Figure 12A:
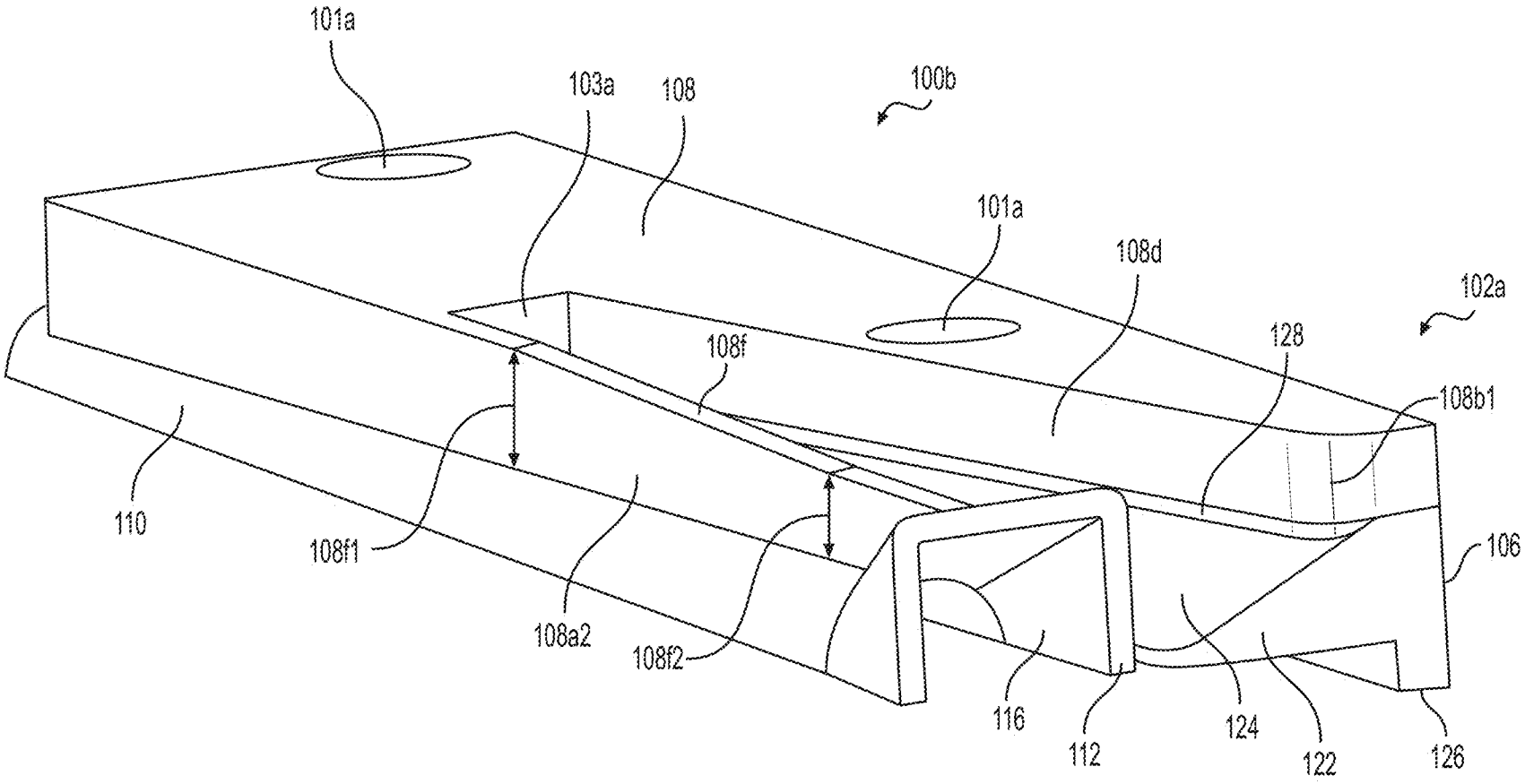
FIG. 12A is an illustration of a front, upper perspective view of a second embodiment of a tongue assembly, in accordance with an example embodiment.

In an example embodiment, the tongue assembly 100 does not include the upper mounting plate 104 (see the example embodiment of FIG. 12A). In this example embodiment, the shaft 110, or the overall tongue 102, is made from a hard material, such as metal (as described above), that resists deformation and/or warping during use in the rod forming apparatus 10.

In an example embodiment, the upper mounting plate 104 and/or the lower mounting plate 106 are integrally and/or monolithically formed with the tongue 102, such that the upper mounting plate 104 and/or the lower mounting plate 106 are not separate elements from the tongue 102.

Figure 10B:
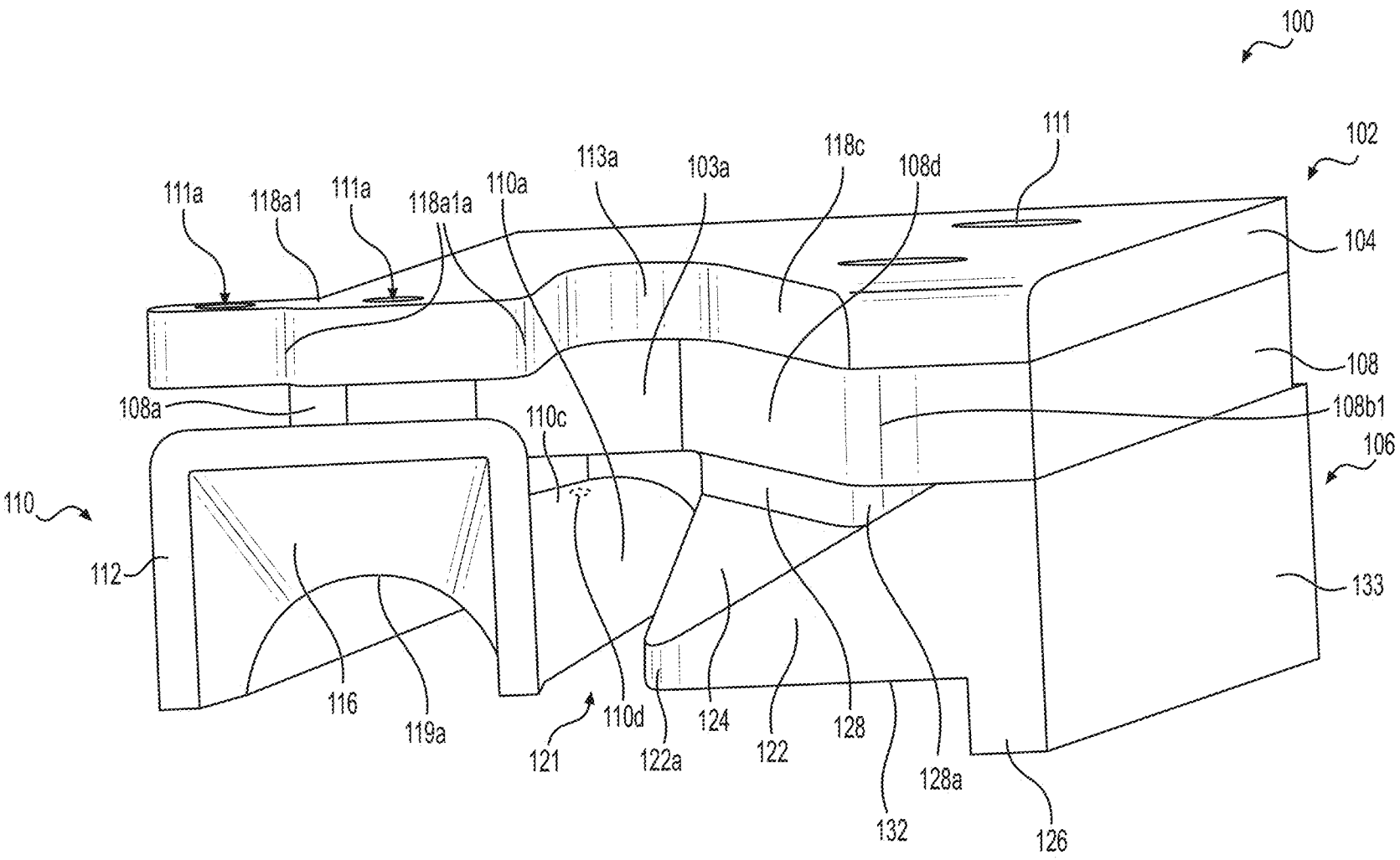
FIG. 10B is an illustration of a front perspective view of the tongue assembly, in accordance with an example embodiment.

FIG. 10B is an illustration of a front perspective view of the tongue assembly 100, in accordance with an example embodiment. In an example embodiment, the tongue assembly 100 defines an opening 121 for the lap edge 33 of the at least one covering 31 (see FIG. 15A) to pass through. In an example embodiment, the opening 121 is defined by at least the following elements: the first outer side surface 110*a* of the shaft 110, the inclined surface 124 of the lower mounting plate 106, an outer edge 130*a* below the inclined surface 124 (see FIG. 11B), the angled surfaces 128/108*d*/118*c*, the first protrusion 108*a* of the tongue 102, the lower surface 108*c* of the upper plate 108 of the tongue 102, and a side surface 130 of the lower mounting plate 106 (see FIG. 11B). In an example embodiment, the opening 121 is able to accommodate the at least one covering 31, where the at least one covering 31 is relatively wide. In an example embodiment, a width of the at least one covering 31 is about 25 mm to 36 mm, or about 30 mm to 36 mm, or about 34 mm.

In an example embodiment, and as shown in at least FIGS. 1 and 3, the tobacco column 1*a* flows through the squeeze bars 60/62, and is compressed down to a tobacco rod 1*b* (FIG. 15A), whereupon the tobacco rod 1*b* and the at least one covering 31 enter and flow through the compression box 100*a*. Specifically, in an example embodiment, the tobacco rod 1*b* flows between the shaft 110 of the tongue 102 and a groove 152 of the lower plate 150 (see FIG. 13A), as the lap edge 33 of the at least one covering 31 enters and passes through the opening 121 of the tongue assembly 100. Specifically, in an example embodiment, the lap edge 33 of the at least one covering 31 slides along the inclined surface 124 within the opening 121, before being partially folded toward the tobacco rod 1*b* as the lap edge 33 contacts the side surface 130 of the lower mounting plate 106 (FIG. 11B). In an example embodiment, a width of the inclined surface 124 is continually reduced, from a front end to a back end of the inclined surface 124 (also shown in in FIG. 11B), to cause the lap edge 33 of the at least one covering 31 to fold toward the upper surface 110*c* of the shaft 110, as the lap edge 33 travels through the tongue assembly 100. In an example embodiment, as the tobacco rod 1*b* exits the outlet 114 of the tongue 102 of the compression box 100*a*, the tobacco rod 1*b* and the at least one covering 31 are in a configuration as shown in FIG. 15B (where FIG. 15B is view B-B of FIG. 1).

In an example embodiment, one or more of the following corners are beveled (rounded), in the event the lap edge 33 of the at least one covering 31 may contact them, so that the at least one covering 31 is not inadvertently torn or damaged: the front comer 122*a* of the shelf 122, the front corner 128*a* of the angled surface 128, the front corner 108*b*1 of the angled surface 108*d*, and the beveled corners 118*a*1*a* of the enlarged end portion 118*a*1 of the upper mounting plate 104.

In an example embodiment, a side surface 133 of the lower mounting plate 106 is substantially flat.

In an example embodiment, an injection port 110*d* is defined by the shaft 110, where the injection port 110*d* (FIG. 10B) penetrates the inner surface 119 of the shaft 110. In an example embodiment, the injection port 110*d* is defined by the upper surface 110*c* of the shaft 110. In an example embodiment, the injection port 110*d* is defined at any location along the longitudinal length of the shaft 110. In an example embodiment, the injection port 110*d* is defined by the tapered entrance 116. In an example embodiment, the injection port 110*d* is used to inject at least one substance into the inside of the shaft 110, while the rod forming apparatus 10 is in use. In an example embodiment, the at least one substance is water. In an example embodiment, water injection at the injection port 110*d* is used to clean the shaft 110, and lubricate the inner surface 119 of the shaft 110. In an example embodiment, the water injection at the injection port 110*d* is used to increase a moisture content of the tobacco rod 1*b*.

In an example embodiment, the at least one substance is at least one flavorant that can become commingled with the tobacco rod 1*b*, as the tobacco rod 1*b* flows through the shaft 110. In an example embodiment, the at least one flavorant may be at least one of a natural flavorant, an artificial flavorant, or a combination of a natural flavorant and an artificial flavorant. For instance, the at least one flavorant may include menthol, etc. In an example embodiment, the at least one substance is at least one additive. In an example embodiment, the at least one additive changes a property of the tobacco in the tobacco rod 1*b*. In an example embodiment, the additive includes a humectant. In an example embodiment, the humectant is used to adjust or maintain a moisture content of the tobacco rod 1*b*, act as a preservative for the tobacco rod 1*b*, or both. In an example embodiment, examples of humectants include glycerol, propylene glycol, or combinations thereof. In an example embodiment, the humectant reduces a water activity in the consumer product 300, thereby reducing an opportunity for growth of microorganisms. In an example embodiment, the humectant provides a higher moisture feel for a potentially dry composition of the tobacco 1. In an example embodiment, the at least one substance is water, the at least one flavorant, the at least one additive, or combinations thereof.

Figure 10C:
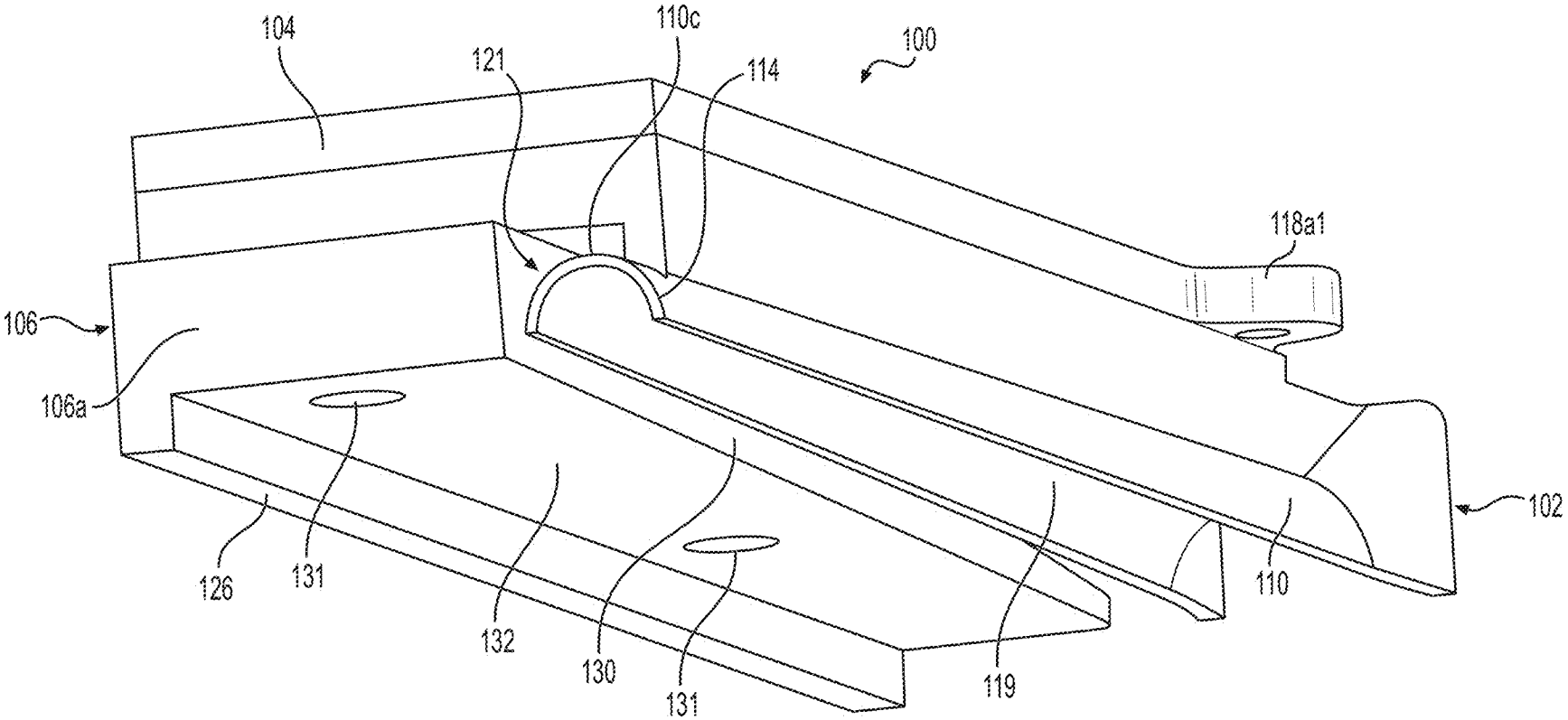
FIG. 10C is an illustration of a lower, rear perspective view of the tongue assembly, in accordance with an example embodiment.

FIG. 10C is an illustration of a lower, rear perspective view of the tongue assembly 100, in accordance with an example embodiment. In an example embodiment, and as shown in FIG. 10C, a lower surface 132 of the lower mounting plate 106 is substantially flat. In an example embodiment, the protrusion 126 extends along an edge of the lower surface 132. In an example embodiment, the one or more mounting bolt holes 131 of the lower mounting plate 106 traverse through the lower surface 132.

In an example embodiment, an elevation (height) of the upper surface 110*c* of the shaft 110 is about even with an elevation of the adhesive applicator 40 (FIG. 1). In an example embodiment, the lap edge 33 of the at least one covering 31 is raised up, as it passes over inclined surface 124 (see FIG. 10B), and the lap edge 33 curls over and is substantially at the elevation of the upper surface 110*c*, as the lap edge 33 passes through the end of the opening 121, so that the lap edge 33 is out of the way and allows the adhesive applicator 40 to access and apply the adhesive 35 to the free edge 37 of the at least one covering 31 (see FIG. 15B), as the at least one covering 31 passes through the back end of the tongue assembly 100.

Figure 10D:
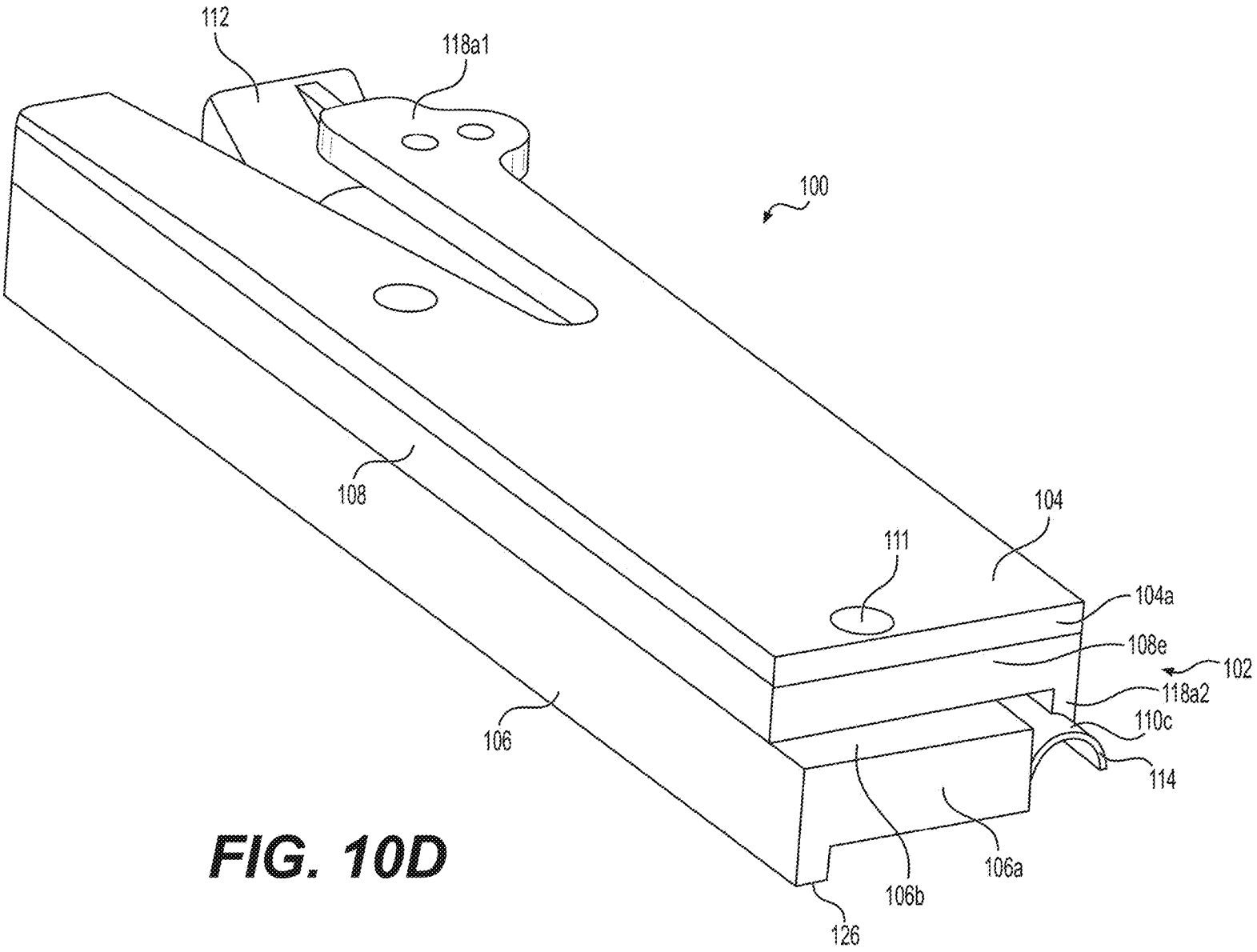
FIG. 10D is an illustration of an upper, rear perspective view of the tongue assembly, in accordance with an example embodiment.

FIG. 10D is an illustration of an upper, rear perspective view of the tongue assembly 100, in accordance with an example embodiment. In an example embodiment, an end surface 104*a* of the upper mounting plate 104 is substantially aligned with an end surface 108*e* of the tongue 102. In an example embodiment, the end surface 106*a* of the lower mounting plate 106 extends from the end surfaces 104*a*/108*e*, thereby creating a step 106*b* that is formed by the lower mounting plate 106.

In an example embodiment, an extension 118*a*2 of the upper plate 108 connects to the upper surface 110*c* of the shaft 110.

Figure 11A:
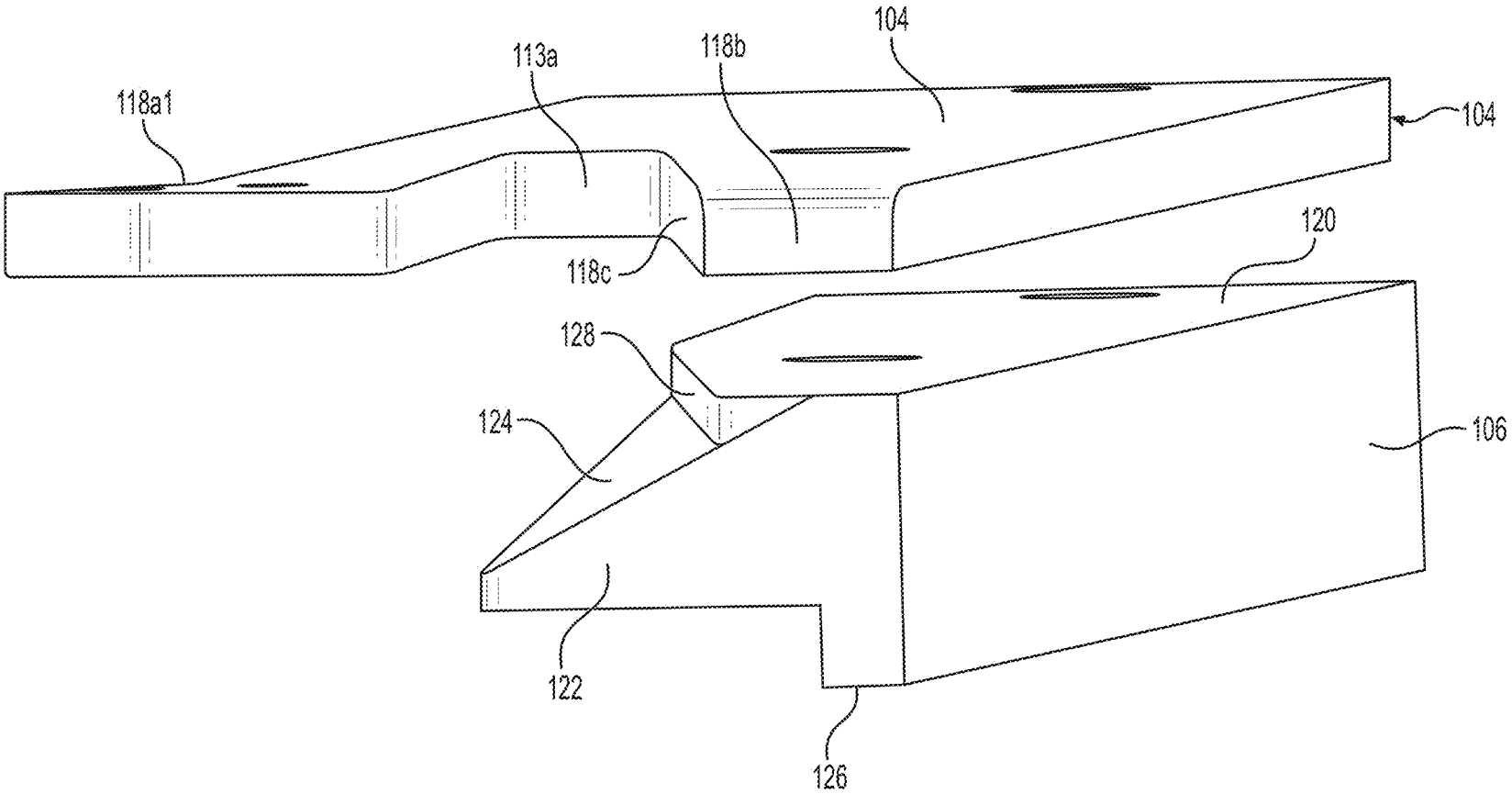
FIG. 11A is an illustration of a perspective view of mounting plates for the tongue assembly, in accordance with an example embodiment.
Figure 11B:
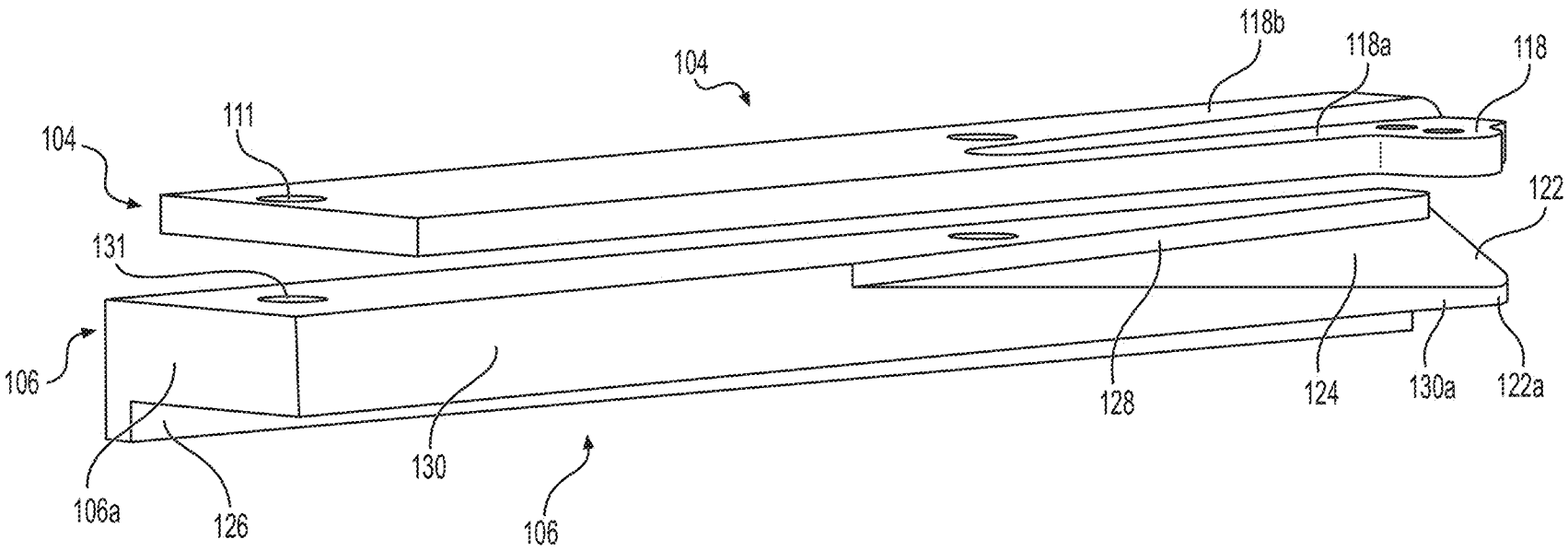
FIG. 11B is an illustration of another perspective view of the mounting plates for the tongue assembly, in accordance with an example embodiment.

FIG. 11A is an illustration of a perspective view of the upper mounting plate 104 and the lower mounting plate 106 for the tongue assembly 100, in accordance with an example embodiment. In an example embodiment, and as shown in FIG. 11A, the mounting plates 104/106 are shaped so that the lap edge 33 of the at least one covering 31 is able to smoothly enter the compression box 100*a* by passing over the inclined surface 124. Depending on an overall width of the at least one covering 31, the lap edge 33 may glance along the angled surface 128 of the lower mounting plate 106 and/or the angled surface 118*c* of the upper mounting plate 104, and may also contact the curved inner surface 113*a* of the upper mounting plate 104, prior to being gently folded toward the tobacco rod 1*b* (see FIG. 15B, which is view B-B of FIG. 1), as the at least one covering 31 exits the tongue assembly 100 between the outlet 114 of the shaft 110 and the side surface 130 of the lower mounting plate 106 (see FIG. 10C).

In an example embodiment, a top surface 120 of the lower mounting plate 106 is substantially flat, and mates with the lower surface 108*c* of the upper plate 108 of the tongue 102.

FIG. 11B is an illustration of another perspective view of the upper mounting plate 104 and the lower mounting plate 106 for the tongue assembly 100, in accordance with an example embodiment. In an example embodiment, the shelf 122 extends from a side of the lower mounting plate 106, where the inclined surface 124 of the shelf 122 extends along about half of a longitudinal length of the lower mounting plate 106.

Figure 11C:
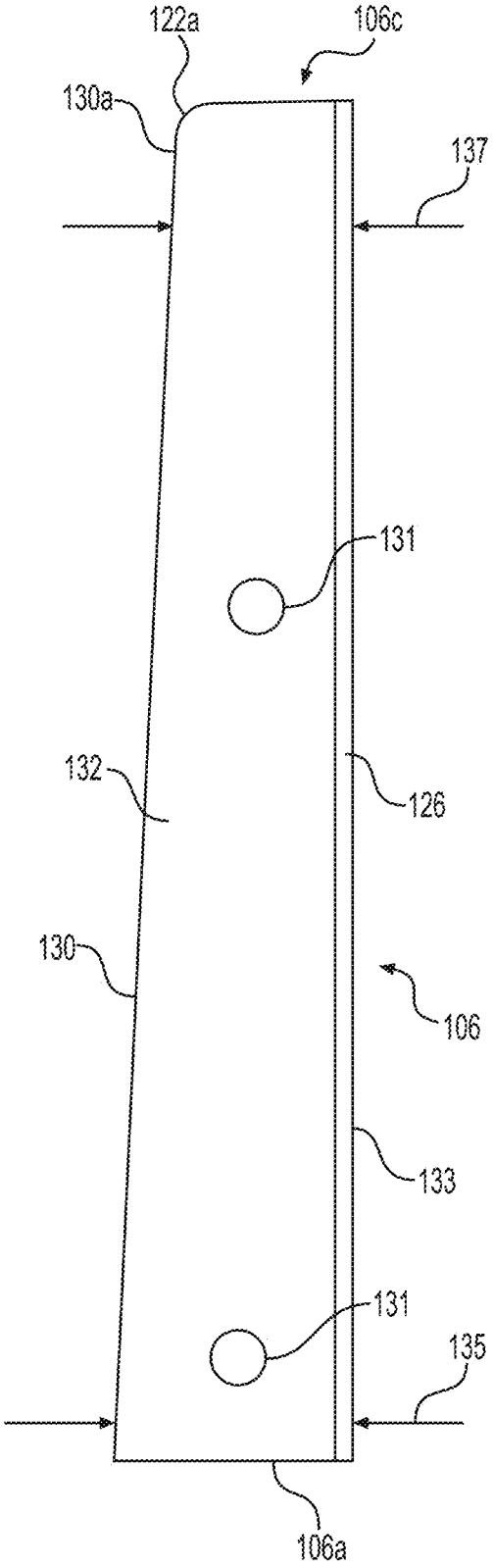
FIG. 11C is an illustration of a lower view of the lower mounting plate for the tongue assembly, in accordance with an example embodiment.

FIG. 11C is an illustration of a lower view of the lower mounting plate 106 for the tongue assembly 100, in accordance with an example embodiment. In an example embodiment, a first width 135 of the lower mounting plate 106 is larger than a second width 137 of the lower mounting plate 106. In an example embodiment, the side surface 130 is angled, relative to the side surface 133 and the end surface 106*a*, to cause the width of the lower mounting plate 106 to narrow toward a front end 106*c* of the mounting plate 106. In an example embodiment, the width of the lower mounting plate 106 continually narrows, from the end surface 106*a* to the front end 106*c* of the mounting plate 106.

FIG. 12A is an illustration of a front, upper perspective view of a second embodiment of a tongue assembly 100*b*, in accordance with an example embodiment. In an example embodiment, the shaft 110, or the upper plate 108, or the tongue 102*a* as a whole, are made from a hard material that resists deformation and/or warping during use in the rod forming apparatus 10. In an example embodiment, the hard material is a metal. In an example embodiment, the metal is at least one of stainless steel, carbon steel, or combinations thereof. In an example embodiment, the inner surface 119 of the shaft 110 and the tapered entrance 116, or at least some of the surfaces of the tongue 102*a*, or surfaces of the tongue 102*a* that contact the tobacco rod 1*b* and/or the at least one covering 31, are coated with a food-safe coating. In an example embodiment, the food-safe coating includes at least one of a food-safe plastic, polymer material, a polyether ether ketone (PEEK), or combinations thereof.

In some example embodiments where the shaft 110, and/or the upper plate 108, or the tongue 102*a* as a whole are made from a hard material, the tongue assembly 100*b* does not include an upper mounting plate (such as the upper mounting plate 104 of FIG. 10A). In this example embodiment, the upper plate 108 of the tongue 102*a* may constitute an upper surface of the tongue assembly 100*b*.

Figure 12B:
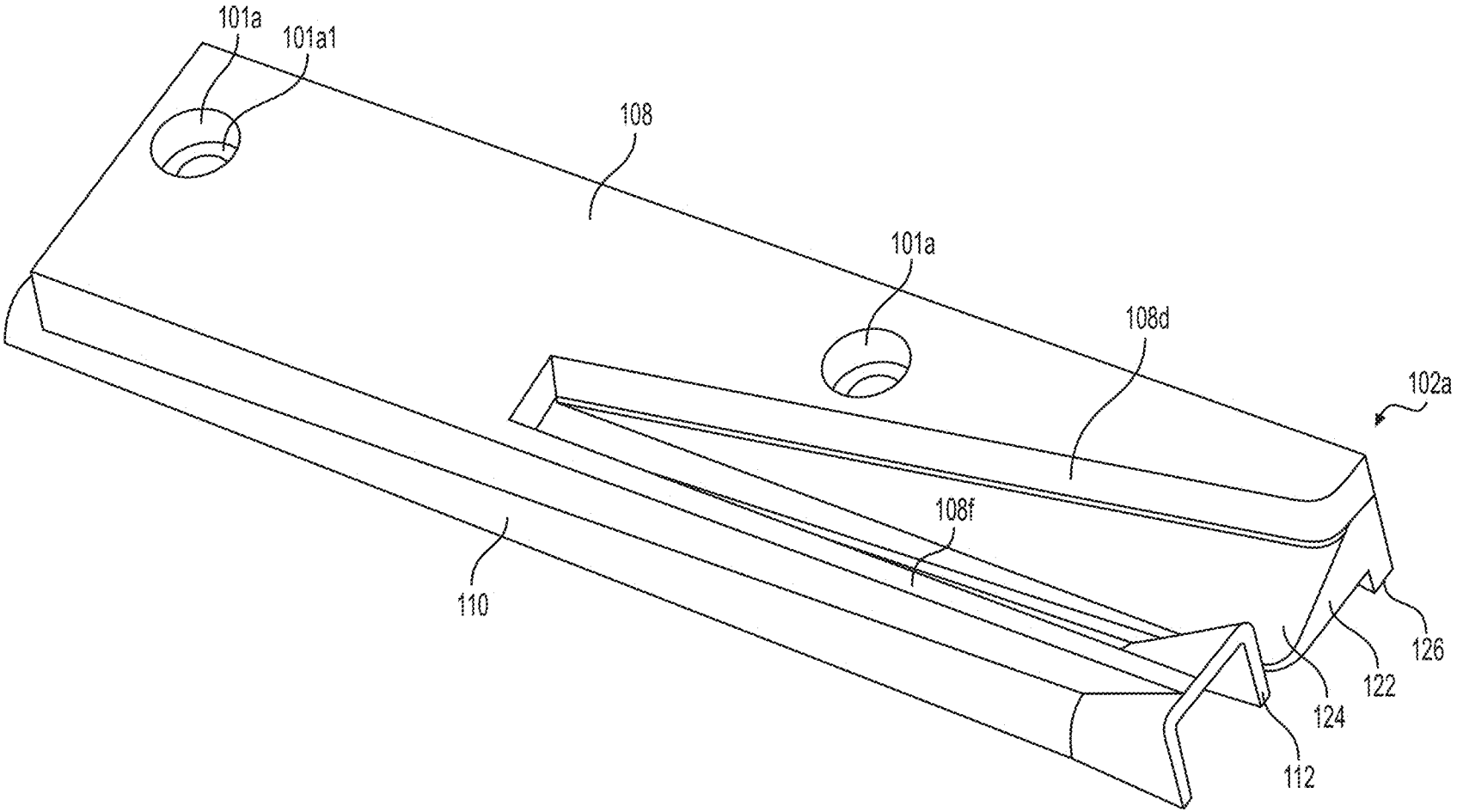
FIG. 12B is an illustration of an upper perspective view of the second embodiment of the tongue assembly, in accordance with an example embodiment.

In an example embodiment, the upper plate 108 of the tongue 102*a* includes one or more bolt holes 101 that are counter-sunk holes (as shown in better detail in FIG. 12B). In an example embodiment, the tongue 102*a* includes a first protrusion 108*a*2 connected to the shaft 110. In an example embodiment, the first protrusion 108*a*2 includes an upper surface 108*f* that is downwardly-sloped, such that a first height 108*f*1 of the upper surface 108*f* has a higher elevation than a second height 108*f*2 of the upper surface 108*f*.

In an example embodiment, the lower mounting plate 106 of the tongue assembly 100*b* is formed as a separate element from the tongue 102*a*. In an example embodiment, the lower mounting plate 106 is connectable to the upper plate 108 via the use of the bolts. In other example embodiments, the lower mounting plate 106 is formed integrally, or monolithically, with the upper plate 108 of the tongue 102*a*, such that the lower mounting plate 106 is a permanent or integral portion of the tongue 102*a*.

FIG. 12B is an illustration of an upper perspective view of the second embodiment of the tongue assembly 100*b*, in accordance with an example embodiment. As shown in FIG. 12B, the one or more bolt holes 101*a* are counter-sunk, such that a counter-sunk surface 101*a*1 exists below an upper surface of the upper plate 108 of the tongue 102*a*.

Figure 13A:
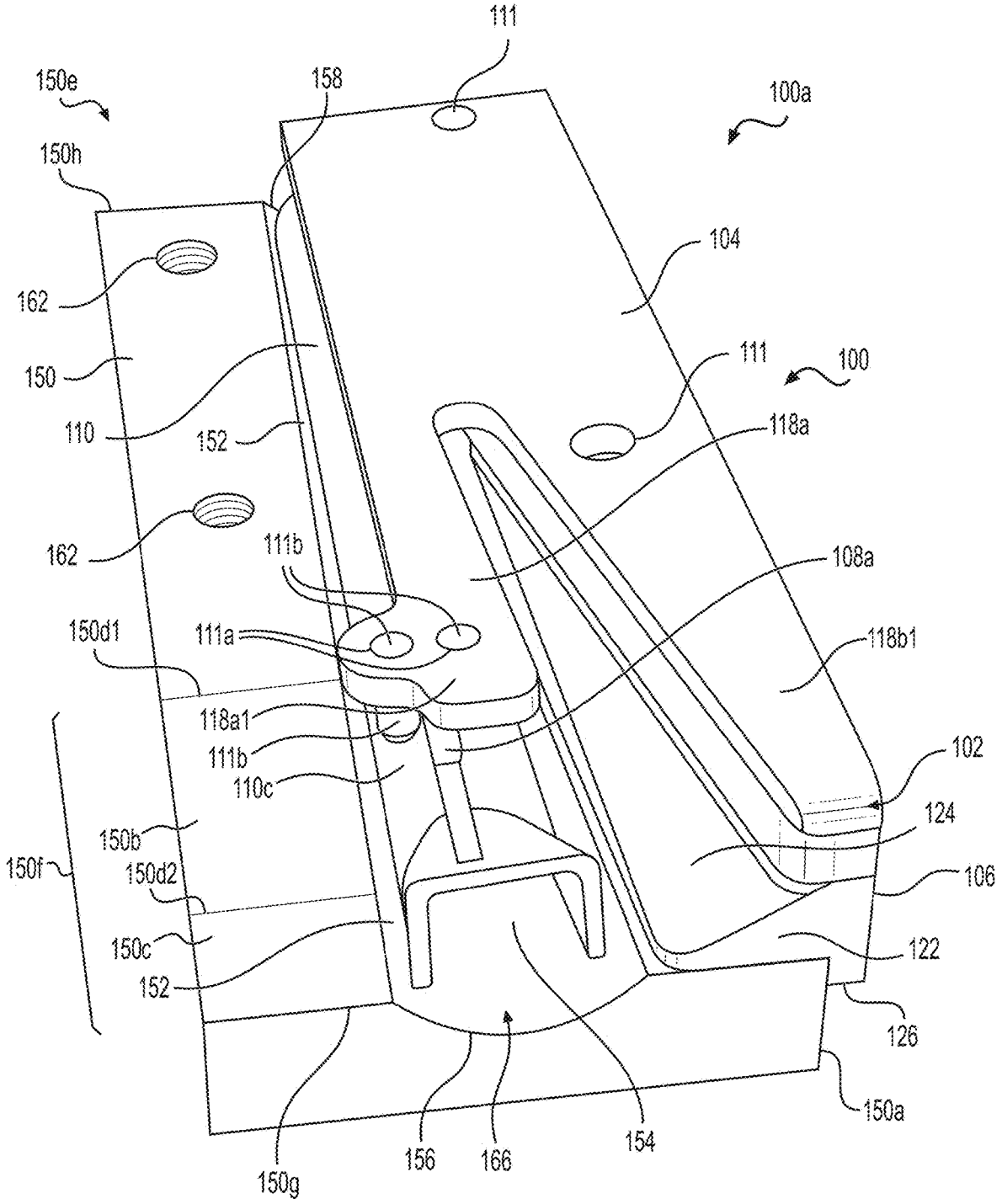
FIG. 13A is an illustration of a perspective view of the compression box, in accordance with an example embodiment.

FIG. 13A is an illustration of the compression box 100*a*, in accordance with an example embodiment. In an example embodiment, the compression box 100*a* includes the lower plate 150, where the tongue assembly 100 is mounted on the lower plate 150.

In an example embodiment, the protrusion 126 of the lower mounting plate 106 can align with a side surface 150*a* of the lower plate 150, to stabilize the tongue assembly 100 on the lower plate 150 and ensure that the tongue assembly 100 is properly aligned on the lower plate 150. In an example embodiment, the mounting bolt holes 111 of the upper mounting plate 104 align with the bolt holes 101 of the tongue 102 (FIG. 9A) and the one or more mounting bolt holes 131 of the lower mounting plate 106 (FIG. 11B), so that bolts 163 (FIG. 14) can penetrate through the tongue assembly 100 and reach one or more mounting bolt holes 164 in the lower plate 150 (see FIG. 13C). In an example embodiment, the one or more mounting bolt holes 164 of the lower plate 150 are threaded to mate with the bolts 163.

In an example embodiment, the tongue assembly 100 can be properly aligned on the lower plate 150, via the bolts 163 that penetrate through the tongue assembly 100 and mate with the one or more mounting bolt holes 164 in the lower plate 150, where the protrusion 126 provides another point of contact to align the tongue assembly 100. In an example embodiment, the one or more mounting bolt holes 164 include two mounting bolt holes in the lower plate 150, where two of the bolts 163 fasten the tongue assembly 100 to the lower plate 150, and where the protrusion 126 provides a third point of contact to align the tongue assembly 100 on the lower plate 150. In an example embodiment, when the tongue assembly 100 is properly aligned on the lower plate 150, the shaft 110 is centrally aligned with a groove 152 that runs along a longitudinal length of the lower plate 150 (shown in better detail in FIG. 13C). In an example embodiment, the groove 152 of the lower plate 150 has an arcuate shaped surface 154. In an example embodiment, an arcuate shaped inlet 156 of the groove 152 has a larger radius of curvature than an arcuate shaped outlet 158 of the groove 152. In an example embodiment, when the tongue assembly 100 is properly mounted on the lower plate 150, the inner surface 119 of the shaft 110 and the arcuate shaped surface 154 of the lower plate 150 longitudinally align to form a channel 166, where the channel 166 has a substantially circular cross-sectional flow area.

In an example embodiment, a free-side 150*e* of the lower plate 150 (a side of the lower plate 150 that is not being used to bolt the tongue assembly 100 to the lower plate 150), includes an inclined portion 150*f*. In an example embodiment, the inclined portion 150*f* provides a gradually increasing depth to the free-side 150*e* of the lower plate 150, in an example embodiment, the inclined portion 150*f* may include an upper surface that includes a flat portion 150*c*, between a front edge 150*g* of the lower plate and a valley 150*d*2 of the lower plate 150. In an example embodiment, the inclined portion 150*f* further includes an inclined surface 150*b*, between the valley 150*d*2 and a ridge 150*d*1. In an example embodiment, a remaining upper surface of the free-side 150*e* of the lower plate 150 may have a common, elevated height. The inclined portion 150*f*, with the flat portion 150*c* and the inclined surface 150*b*, can be seen in better detail in FIG. 14, where the inclined surface 150*b* has an elevation (height) 150*b*2 that increases from a lower elevation 150*b*3 of the flat portion 150*c* to a higher elevation 150*d*1 of the remainder of the lower plate 150. In an example embodiment, a purpose of a gradual elevation of the lower plate 150, from the front edge (leading edge) 150*g* of the lower plate 150 to a back edge 150*h* of the lower plate 150, is to cause the free edge 37 of the at least one covering 31 to transition from a 'flared out' configuration (as shown in FIG. 15A) to a vertical configuration (as shown in FIG. 15B). This allows the free edge 37 of the at least one covering 31 to be in a proper orientation as the free edge 37 passes by the adhesive application 40.

In an example embodiment, the lower plate 150 includes one or more mounting bolt holes 162 that can be used to mount the lower plate 150 on the rod forming apparatus 10.

In an example embodiment, and as shown in FIG. 13A, bolts 111*b* can be threaded through the one or more bolt holes 101*a* of the upper mounting plate, where each of the bolts 111*b* may straddle and hug sides of the first protrusion 108*a* of the tongue 102. In an example embodiment, because the radius of curvature of the arcuate shaped inlet 156 of the groove 152 is larger than the arcuate shaped outlet 158, the resulting channel 166 has a smaller diameter (smaller cross-sectional flow area) from the front to the back of the channel 166, thereby compressing the tobacco rod 1*b* (FIG. 15A) as the tobacco rod 1*b* flows through the compression box 100*a*. In an example embodiment, the channel 166 can have a cross-sectional flow area that is a shape that is non-circular.

Figure 13B:
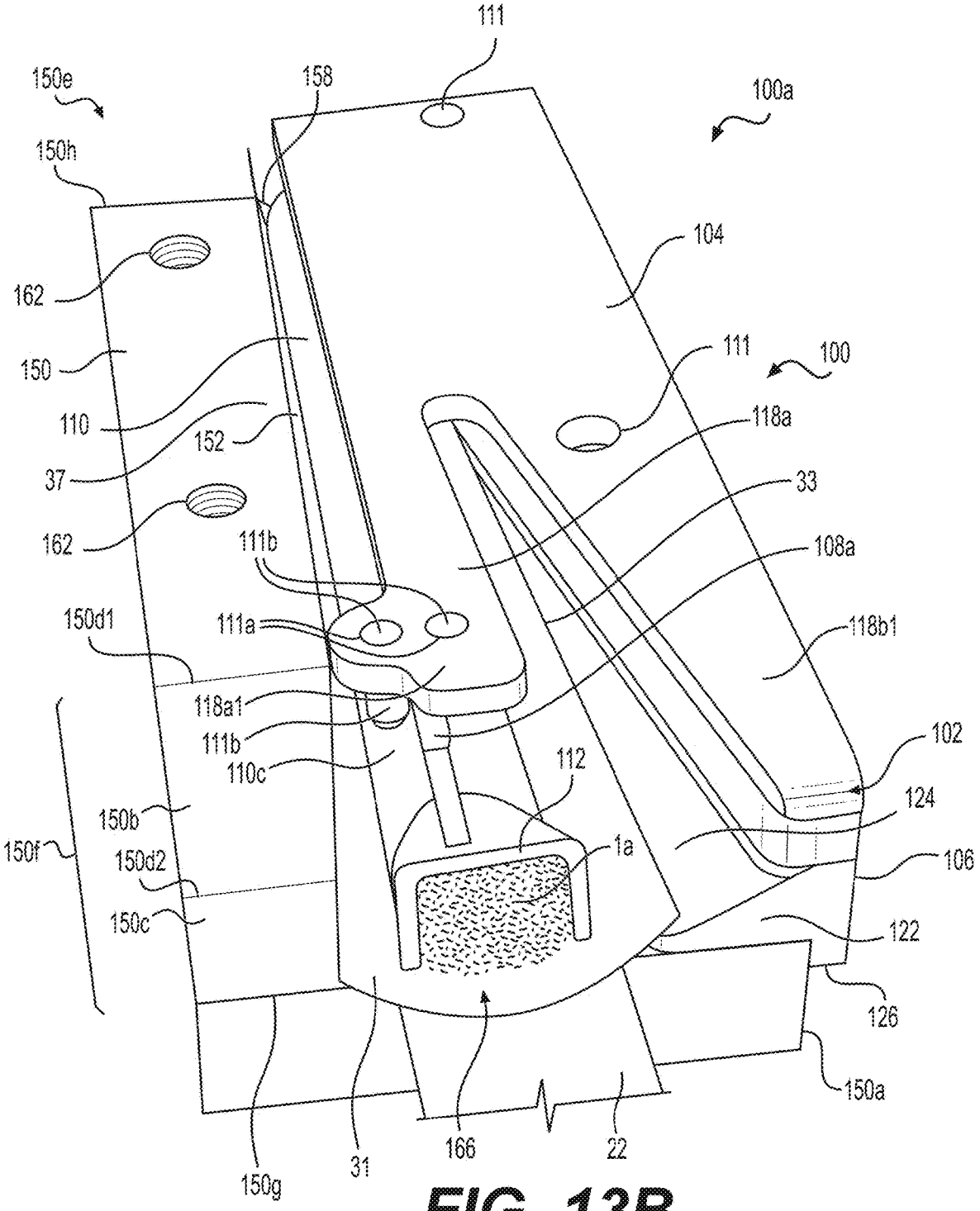
FIG. 13B is an illustration of a perspective view of the compression box, with the lower belt and the at least one covering shown passing through the compression box, in accordance with an example embodiment.

FIG. 13B is an illustration of a perspective view of the compression box 100*a*, with the lower belt 22 and the at least one covering 31 shown passing through the compression box 100*a*, in accordance with an example embodiment. In an example embodiment, and as shown in FIG. 13B, the lower belt 22 passes between the lower plate 150 and the shaft 110 of the tongue assembly 100, causing the at least one covering 31 to be moved through the compression box 100*a* as the at least one covering 31 moves on top of the lower belt 22. Movement of the lower belt 22 and the at least one covering 31 causes the tobacco column 1*a* to enter the inlet 112, and cause the tobacco column 1*a* to be compressed into the tobacco rod 1*b*, as the tobacco flows into and through the shaft 110 (as shown in FIG. 15A).

In an example embodiment, and as shown in FIG. 13B, the free edge 37 of the at least one covering 31 initially enters the compression box 100*a* in the 'flared out' configuration (also see FIG. 15A), and the tongue assembly 100 causes the free edge 37 to become slightly folded into a substantially vertical orientation (see FIG. 15B), as the free edge 37 passes through the compression box 100*a*. As discussed in association with FIG. 14, the movement of the free edge 37, from the 'flared out' configuration to the substantially vertical orientation (FIGS. 15A and 15B), is assisted at least in part by the inclined portion 150*f* of the lower plate 150.

In an example embodiment, and as shown in FIG. 13B, the folded edge 33 of the at least one covering 31 travels along the inclined surface 124 of the tongue assembly, as the inclined surface 124 directs the folded edge 33 through the compression box 100*a* and assists in folding the folded edge 33 over so that an upper surface of the folded edge 33 is folded onto a top of the tobacco rod 1*b*, as shown in at least FIG. 15B.

Figure 13C:
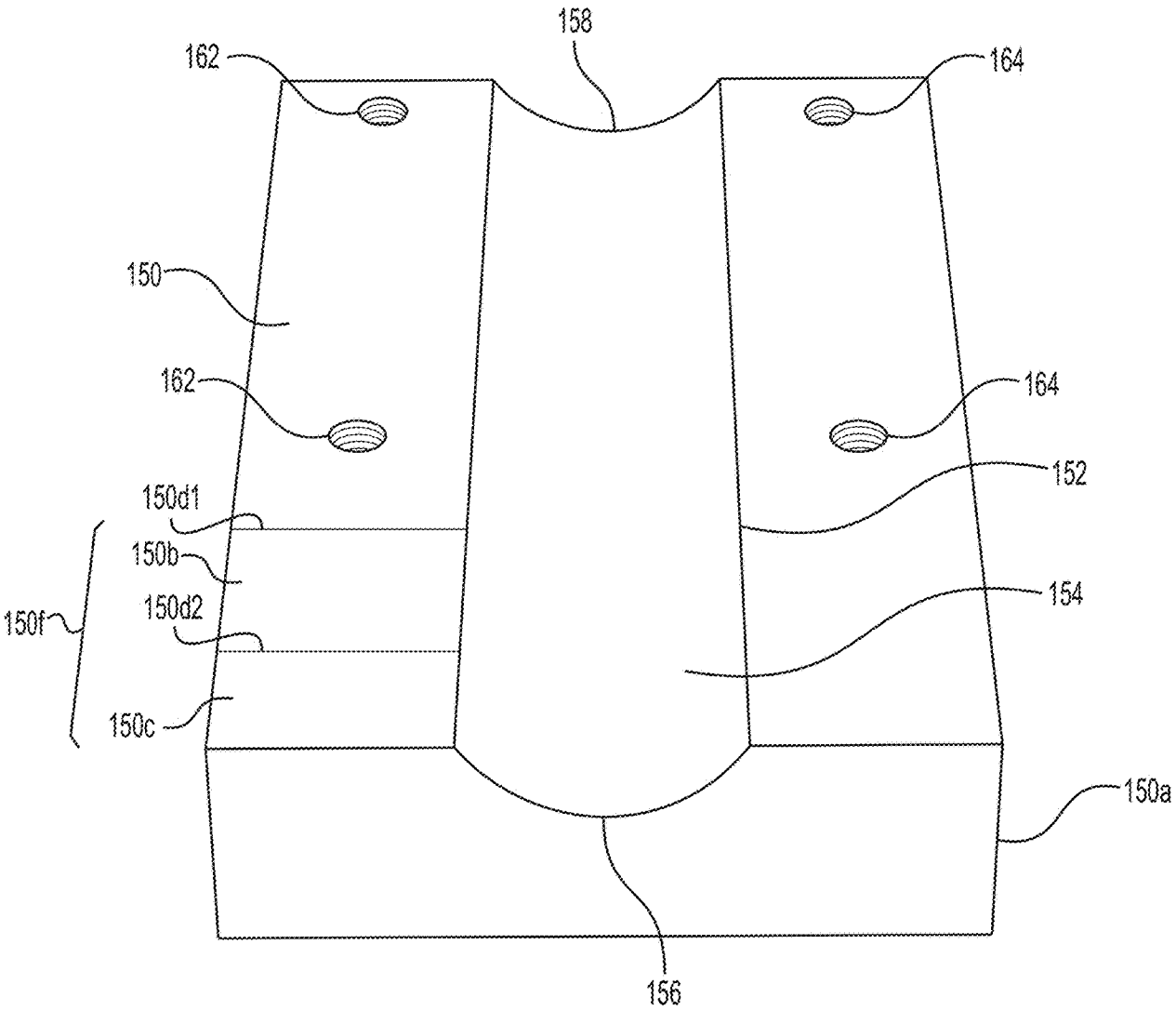
FIG. 13C is an illustration of a lower plate of the compression box, in accordance with an example embodiment.

FIG. 13C is an illustration of the lower plate 150 of the compression box 100*a*, in accordance with an example embodiment. In an example embodiment, and as shown in FIG. 13C, the groove 152 runs along an upper surface of the lower plate 150. In an example embodiment, the one or more mounting bolt holes 164 used to connect the tongue assembly 100 to the lower plate 150 are on one side of the groove 152. In an example embodiment, the mounting bolt holes 162 used to mount the lower plate 150 onto the rod forming apparatus 10 are on one side of the groove 152. In another example embodiment, the one or more mounting bolt holes 164 can be on either side of the groove 152 on the lower plate 150, just as the mounting bolt holes 162 can be on either side of the groove 152.

FIG. 14 is an illustration of a perspective view of the tongue assembly 100 of the compression box 100*a* interfacing with the in-feed section 4, in accordance with an example embodiment. In an example embodiment, a gap 92 exists between the inlet 112 of the tongue assembly 100 and the in-feed belt 20. In an example embodiment, the gap 92 allows the in-feed belt 20 to travel in front of the inlet 112, without contacting the inlet 112 or the tongue assembly 100. In an example embodiment, the tip 86 of the squeeze bars 60/62 guide the tobacco column 1*a* into the inlet 112 of the tongue assembly 100.

In an example embodiment, the lower belt 22 travels between the lower plate 150 and the tongue assembly 100 (obstructed from view in FIG. 14, but shown in better detail in FIG. 13B), where the lower belt 22 is directly below the at least one covering 31. Specifically, in an example embodiment, the lower belt 22 passes under the shaft 110 of the tongue assembly 100, where a lower surface of the lower belt 22 travels along and directly contacts the arcuate shaped surface 154 of the lower plate 150 and an upper surface of the lower plate 150 (see FIGS. 13A, 13B and 13C). In an example embodiment, the lower belt 22 can lay on top of, and pass over, the inclined surface 124 of the tongue assembly 100.

In an example embodiment, and as shown in FIG. 14, the free edge 37 of the at least one covering 31 enters the compression box 100*a* in the 'flared out' configuration (also see FIG. 15A). In an example embodiment, as the free edge 37 passes through the compression box 100*a*, between the shaft 110 and the free side 150*e* of the lower plate 150, the inclined portion 150*f* of the lower plate 150 may assist in folding the free edge 37 from the 'flared out' configuration to the substantially vertical configuration (see FIG. 15B). In an example embodiment, this folding of the free edge 37 will cause the free edge 37 to be in a proper configuration for the adhesive applicator 40 to apply the adhesive to the free edge 37 (see the adhesive 35 being applied in FIG. 15B), either after the compression box 100*a* where the adhesive applicator 40 applies the adhesive 35 at location 40*a*, or after the short folder 42 (see the adhesive applicator 40 locations, in FIG. 1).

In an example embodiment, and as shown in FIG. 14, the lap (folded) edge 33 of the at least one covering 31 enters the compression box 100*a* in a 'flared out' configuration (see FIG. 15A), and is folded over on top of the tobacco rod 1*b* as the at least one covering 31 exits the compression box 100*a* (see FIG. 15B). Specifically, the lap edge 33 of the at least one covering 31 passes through the compression box 100*a* by traveling along the inclined surface 124 (as shown in FIG. 13B), before being folded over. In an example embodiment, the short folder 42 pins the lap edge 33 down, to cause the lap edge 33 to be folded onto the tobacco rod 1*b*, as shown in FIG. 14 (where a lower surface, or the wrapper web 34 side of the at least one covering 31, is depicted between the compression box 100*a* and the short folder 42).

FIG. 15A is an illustration of the cross-sectional view (view A-A of FIG. 1) of the tobacco rod 1*b* being bound, in accordance with an example embodiment. In an example embodiment, and as shown in FIG. 15A, the tobacco rod 1*b* is formed by the tobacco column 1*a* flowing between the tips 86 of the horizontal portion 84 of the squeeze bars 60/62, and flowing into the inlet 112 of the tongue assembly 100, where the tobacco column 1*a* is transformed from a column with a square-shaped or a rectangular-shaped cross-section (matching a cross-section of the inlet 112) into a circular-shaped cross-section, as the tobacco column 1*a* is pressed into the circular shaped channel 166 of the compression box 100*a* (see FIG. 13A). To be clear, the tobacco rod 1*b* shown in FIG. 15A, is the cross-sectional view of the tobacco rod 1*b* after the tobacco has passed into the inlet 119*a* of the shaft 110 of the tongue assembly 100.

In an example embodiment, the lap (folded) edge 33 and free edge 37 of the at least one covering 31 remain extended, in the 'flared out' configuration relative to the tobacco rod 1*b* (as shown in FIG. 15A), where a mid-section 31*a* of the at least one covering 31 is contacting, and is partially wrapped around, a surface of the tobacco rod 1*b*, as the tobacco rod 1*b* enters the tongue assembly 100.

FIG. 15B is another illustration of the cross-sectional view (view B-B of FIG. 1) of the tobacco rod 1*b* being bound, in accordance with an example embodiment. In an example embodiment, and as shown in FIG. 15B, the tobacco rod 1*b* and the at least one covering 31 has already passed by the adhesive applicator 40, and the adhesive 35 has been applied to an upper (inner) surface of the free edge 37 of the at least one covering 31 (see FIG. 1). In an example embodiment, and as shown in FIG. 15B, the lap edge 33 is being folded toward the tobacco rod 1*b* as the tobacco rod 1*b* enters the short folder 42, where the short folder 42 is at least partially assisting in pinning the lap edge 33 down so that the lap edge 33 is laying over the tobacco rod 1*b*.

FIG. 15C is another illustration of the cross-sectional view the tobacco rod 1*b* (view C-C of FIG. 1) being bound, in accordance with an example embodiment. In an example embodiment, and in this configuration, the tobacco rod 1*b* has passed through the short folder 42 and is entering the finishing folder 44. In this configuration, the lap edge 33 has already been folded over onto the tobacco rod 1*b*, and the free edge 37 of the at least one covering 31 is extended upward and is beginning to be folded (in direction 39) over the top portion of the tobacco rod 1*b*.

FIG. 15D is another illustration of the cross-sectional view the tobacco rod 1*b* (view D-D of FIG. 1) being bound, in accordance with an example embodiment. In an example embodiment, and in this configuration, the tobacco rod 1*b* has passed through the finishing folder 44, where the free edge 37 of the at least one covering 31 has been folded over onto the lap edge 33, and the lap edge 33 and free edge 37 are pinned together on the tobacco rod 1*b* by the adhesive 35.

In an example embodiment, following the finishing folder 44, the tobacco rod 1*b* enters the heater 46 so that the heater 46 may apply heat to the at least one covering 31, in order to cure the adhesive 35 and fuse the at least one covering 31 around the tobacco rod 1*b* to form a finished rod 41. In an example embodiment, the finished rod 41 leaves the heater 46 and enters the cutter 48, to cut sections of the finished rod 41 in order to form the consumer product 300.

FIG. 16 is an illustration of the consumer product 300 that is made from the rod forming apparatus 10, in accordance with an example embodiment. In an example embodiment, the consumer product 300 is a rolled tobacco product. In an example embodiment, the consumer product 300 is a cigar. In another example embodiment, the consumer product 300 is a cigarette.

In an example embodiment, the tobacco 1 is shredded tobacco that is suitable for machine-made cigars. In an example embodiment, the tobacco 1 has a moisture content of about 10-20%, or about 12-18%. In an example embodiment, the tobacco 1 is blended pipe tobacco, or blended packing tobacco, that is suitable for packing a pipe. In an example embodiment, the tobacco 1 is a blend of various types of shredded, moist, tacky tobacco. In an example embodiment, the tobacco 1 is, for example, flue-cured tobacco, Burley tobacco, Maryland tobacco, Oriental tobacco, rare tobacco, specialty tobacco, reconstituted tobacco, or combinations thereof. In an example embodiment, the tobacco 1 is pasteurized. In another example embodiment, the tobacco 1 is fermented.

In an example embodiment, the tobacco 1 includes the at least one substance, as described above, where the at least one substance includes the at least one flavorant, the at least one additive, water (moisture), or combinations thereof. In an example embodiment, the at least one flavorant includes any natural or synthetic flavorant or aroma, such as menthol, etc. In an example embodiment, the at least one flavorant includes flavor compounds that include acids, alcohols, esters, aldehydes, ketones, pyrazines, or combinations thereof. In an example embodiment, the flavor compounds include, for example, phenylacetic acid, solanone, megastigmatrienone, 2-heptanone, benzylalcohol, cis-3-hexenyl acetate, valeric acid, valeric aldehyde, ester, terpene, sesquiterpene, nootkatone, maltol, damascenone, pyrazine, lactone, anethole, iso-valeric acid, ethylacetate, isoamylacetate, propylisobutyrate, isobutylbutyrate, ethylbutyrate, ethylvalerate, benzylformate, limonene, cymene, pinene, linalool, geraniol, or combinations thereof.

In at least one example embodiment, the tobacco 1 used in the manufacture of machine-made cigars, which is made by the rod forming apparatus 10, is a pipe tobacco blend having a degree of tackiness imparted thereto.

Example embodiments have been disclosed herein, it should be understood that other variations may be possible. Such variations are not to be regarded as a departure from the spirit and scope of the present disclosure, and all such modifications as would be obvious to one skilled in the art are intended to be included within the scope of the following claims.

We claim:

1. A tongue for rod forming, comprising:
a shaft, the shaft being hollow; and
an upper plate connected to the shaft, the upper plate including,
a first protrusion on a first side of the upper plate, and
a second protrusion on the first side of the upper plate,
the first protrusion and the second protrusion defining a notch, and
the first protrusion running along at least part of an upper portion of a longitudinal length of the shaft.

2. The tongue of claim 1, wherein the shaft includes,
an inner surface that faces away from the upper plate, the inner surface having a first end and a second end,
a first inlet on the first end of the inner surface,
an outlet on the second end of the inner surface,
wherein the inner surface, the first inlet and the outlet are arcuate-shaped.

3. The tongue of claim 2, wherein the first inlet has a first radius of curvature that is larger than a second radius of curvature of the outlet.

4. The tongue of claim 2, wherein the inner surface has a continually reducing radius of curvature from the first end to the second end of the inner surface.

5. The tongue of claim 2, wherein the shaft further includes,
a second inlet connected to the first end of the inner surface, the second inlet defining an opening with a first cross-sectional flow area that is one of rectangular-shaped or square-shaped, and
a tapered entrance between the second inlet and the first inlet.

6. The tongue of claim 5, wherein the first cross-sectional flow area is larger than a second cross-sectional flow area of the first inlet, and the second cross-sectional flow area is larger than a third cross-sectional flow area of the outlet.

7. The tongue of claim 2, wherein the shaft defines an injection port, the injection port being configured to inject at least one substance onto the inner surface, the at least one substance being at least one of water, at least one flavorant, at least one additive, or combinations thereof.

8. The tongue of claim 1, wherein the upper plate defines one or more mounting bolt holes.

9. The tongue of claim 1, wherein the upper plate defines at least two mounting bolt holes, and at least one of the at least two mounting bolts holes is defined by the second protrusion.

10. The tongue of claim 1, wherein the notch is substantially V-shaped with a flattened vertex.

11. A tongue assembly, comprising:
the tongue of claim 1; and
a lower mounting plate connected to a lower portion of the tongue.

12. The tongue assembly of claim 11, wherein a lower end of the lower mounting plate includes a third protrusion, the third protrusion being positioned to at least partially align and mount the tongue assembly onto a lower plate of a rod forming apparatus.

13. The tongue assembly of claim 12, wherein the shaft is configured to longitudinally align with a groove defined by the lower plate in order to at least partially define a channel.

14. The tongue assembly of claim 13, wherein the shaft defines an injection port, the injection port being configured to inject at least one substance into the channel, the at least one substance being at least one of water, at least one flavorant, at least one additive, or combinations thereof.

15. The tongue assembly of claim 13, wherein the shaft has a continually reduced cross-sectional flow area from an inlet to an outlet of the shaft.

16. The tongue assembly of claim 12, wherein the upper plate and the lower mounting plate each define at least one pair of mounting bolt holes, each of the at least one pair of mounting bolt holes being configured to further align and mount the tongue assembly onto the lower plate.

17. The tongue assembly of claim 11, wherein the lower mounting plate includes a shelf, the shelf extending from an inner side of the lower mounting plate toward the shaft once the tongue assembly is assembled, the shelf including an upwardly facing inclined surface that inclines away from the shaft.

18. The tongue assembly of claim 17, wherein the upwardly facing inclined surface is configured to at least partially assist in folding a lap edge of a covering of a rolled consumer product toward an upper surface of the shaft, as the lap edge of the covering travels through an opening defined by the tongue assembly, if the tongue assembly is mounted onto a rod forming apparatus.

19. The tongue assembly of claim 18, wherein the opening is at least partially defined by, an inner side surface of the shaft, the upwardly facing inclined surface, and a lower surface of the upper plate.

20. The tongue assembly of claim 17, wherein the upwardly facing inclined surface is tapered, such that a width of the upwardly facing inclined surface is continually reduced from a front end to a back end of the upwardly facing inclined surface.

21. The tongue assembly of claim 11, wherein the upper plate includes an upper surface and a lower surface, the lower surface mating with a first surface of the lower mounting plate, the lower surface and the first surface each being substantially flat.

22. The tongue assembly of claim 11, further comprising:

an upper mounting plate connected to a top portion of the tongue.

23. The tongue assembly of claim 22, wherein the upper plate includes an upper surface and a lower surface, the upper surface mating with a first surface of the upper mounting plate and the lower surface mating with a second surface of the lower mounting plate, the upper surface, the lower surface, the first surface, and the second surface each being substantially flat.

24. The tongue assembly of claim 23, wherein the upper mounting plate includes a fourth protrusion and a fifth protrusion, the fourth protrusion mating with the first protrusion and the fifth protrusion mating with the second protrusion.

25. The tongue assembly of claim 24, wherein the fourth protrusion defines at least two bolt holes, the at least two bolt holes being on either side of the first protrusion, the at least two bolt holes being configured to align the upper plate with the upper mounting plate.

26. The tongue assembly of claim 23, wherein the upper plate defines a first notch, and the upper mounting plate defines a second notch, the first notch and the second notch being substantially aligned with each other.

27. The tongue assembly of claim 26, where the first notch and the second notch are both substantially V-shaped.

28. A rod forming apparatus, comprising:

an in-feed section configured to convey a column of tobacco in a downward direction;

a finishing section configured to receive the column of tobacco, the finishing section being configured to roll the column of tobacco into a wrapped tobacco rod, the finishing section including a tongue, the tongue including, a shaft, the shaft being hollow, an upper plate connected to the shaft, the upper plate including, a first protrusion on a first side of the upper plate, and a second protrusion on the first side of the upper plate, the first protrusion and the second protrusion defining a notch, and the first protrusion running along at least part of an upper portion of a longitudinal length of the shaft.

29. The rod forming apparatus of claim 28, wherein the in-feed section includes, an upper belt and an in-feed belt, the upper belt and the in-feed belt defining a descending channel, the descending channel being configured to convey the column of tobacco in the downward direction, a pair of squeeze bars that are configured to receive the column of tobacco from the descending channel, the pair of squeeze bars being configured to compress the column of tobacco, a lower belt configured to move the column of tobacco through the pair of squeeze bars and into the finishing section, and the lower belt being further configured to move at least one covering, positioned below the column of tobacco, into the finishing section.

30. The rod forming apparatus of claim 28, wherein the finishing section further includes, a compression box, the compression box including a lower plate defining a groove, wherein the shaft of the tongue is configured to longitudinally align with the groove, the compression box being configured to further compression the column of tobacco into a tobacco rod, an adhesive applicator, the adhesive applicator being configured to apply an adhesive to a portion of the at least one covering, one or more folders downstream of the compression box, the one or more folders being configured to fold the at least one covering, with the adhesive, around the tobacco rod, and a cutter, the being configured to cut the tobacco rod into rolled consumer products.

31. Method of installing a tongue assembly on a rod forming apparatus, the method comprising:

aligning a shaft of a tongue with a groove, the groove being defined by a lower plate of a compression box;

bolting an upper plate onto the lower plate to stabilize the aligned shaft with the groove, the tongue including, the shaft, the shaft being hollow, an upper plate connected to the shaft, the upper plate including, a first protrusion on a first side of the upper plate, and a second protrusion on the first side of the upper plate, the first protrusion and the second protrusion defining a notch, and the first protrusion running along at least part of an upper portion of a longitudinal length of the shaft.

32. The method of claim 31, wherein the bolting of the upper plate onto the lower plate includes, connecting a lower mounting plate to the upper plate by mating a first upper surface of the lower mounting plate to a first lower surface of the upper plate, the first upper surface and the first lower surface being substantially flat, the lower mounting plate and the upper plate being configured to be bolted together onto the lower plate, the lower mounting plate including, a shelf, the shelf extending from an inner side of the lower mounting plate toward the shaft once the lower mounting plate is connected to the upper plate, the shelf including an upwardly facing inclined surface that inclines away from the shaft.

33. The method of claim 32, wherein the bolting of the upper plate onto the lower plate further includes, connecting an upper mounting plate to the upper plate by mating a second upper surface of the upper plate to a second lower surface of the upper mounting plate, the second upper surface and the second lower surface being substantially flat, the lower mounting plate, the upper mounting plate and the upper plate being configured to be bolted together onto the lower plate, the upper mounting plate including, a fourth protrusion and a fifth protrusion, the fourth protrusion mating with the first protrusion and the fifth protrusion mating with the second protrusion.

34. The method of claim 33, wherein the upper plate defines a first notch, and the upper mounting plate defines a second notch, the first notch and the second notch being substantially aligned with each other once the upper mounting plate is connected to the upper plate.

* * * * *